US007866292B2

(12) United States Patent
LaBere et al.

(10) Patent No.: US 7,866,292 B2
(45) Date of Patent: Jan. 11, 2011

(54) APPARATUS AND METHODS FOR CONTINUOUS VARIABLE VALVE TIMING

(75) Inventors: Rikki Scott LaBere, Maplewood, MN (US); Robert Allen Weaver, Whitefish, MT (US)

(73) Assignee: AES Industries Inc

( * ) Notice: Subject to any disclaimer, the term of this patent is extended or adjusted under 35 U.S.C. 154(b) by 423 days.

(21) Appl. No.: 12/079,449

(22) Filed: Mar. 26, 2008

(65) Prior Publication Data

US 2009/0241875 A1 Oct. 1, 2009

(51) Int. Cl.
*F01L 1/02* (2006.01)

(52) U.S. Cl. ..... 123/90.31; 123/90.15; 123/90.39; 474/133

(58) Field of Classification Search ..... 123/90.27, 123/90.31, 90.15, 90.17, 90.16, 90.2, 90.39; 74/559, 567, 569; 474/133, 135, 900
See application file for complete search history.

(56) References Cited

U.S. PATENT DOCUMENTS 1,599,552 A 9/1926 Chisholm
1,819,743 A 8/1931 Duncan
1,871,268 A 8/1932 Hildebrand
1,925,755 A 9/1933 Hemmingsen
2,183,674 A 12/1939 Arnold
2,279,413 A 4/1942 Read
3,441,009 A 4/1969 Rafanelli
3,496,918 A 2/1970 Finlay
3,626,720 A 12/1971 Meacham et al.
3,641,988 A 2/1972 Torazza et al.
3,683,875 A 8/1972 Chadwick
3,888,217 A * 6/1975 Hisserich ..... 123/90.31
3,978,829 A 9/1976 Takahashi et al.
3,981,624 A 9/1976 Brandon
4,096,836 A 6/1978 Kopich
4,104,995 A 8/1978 Steinboch
4,231,330 A 11/1980 Garcea
4,285,310 A 8/1981 Takizawa et al.
4,327,676 A 5/1982 McIntire et al.
4,332,222 A 6/1982 Papez
4,344,393 A 8/1982 Etoh et al.
4,354,463 A 10/1982 Otani et al.
4,365,597 A 12/1982 Izuka et al.
4,401,069 A 8/1983 Foley
4,484,543 A 11/1984 Maxey
4,494,504 A 1/1985 Yagi
4,499,870 A 2/1985 Aoyama
4,516,542 A 5/1985 Aoyoma et al.
4,520,775 A 6/1985 Nakamura
4,522,179 A 6/1985 Nishimura et al.
4,534,323 A 8/1985 Kato et al.
4,535,731 A 8/1985 Banfi
4,552,112 A 11/1985 Nagao et al.
4,570,590 A 2/1986 Kawai et al.
4,576,127 A 3/1986 Doi et al.
4,584,974 A 4/1986 Aoyama et al.
4,667,636 A 5/1987 Oishi et al.
4,685,429 A 8/1987 Oyaizu (Continued)

*Primary Examiner*—Ching Chang
(74) *Attorney, Agent, or Firm*—Cardle Patent Law chtd

(57) ABSTRACT

Apparatus and methods for shifting the phase between a driver gear and a driven gear in communication by a timing belt are provided as well as methods for configuring the apparatus. The apparatus may continuously vary the phase relationship between the driver gear and the driven gear.

20 Claims, 8 Drawing Sheets

U.S. PATENT DOCUMENTS 4,702,207 A 10/1987 Hatamura et al.
4,715,333 A 12/1987 Oyaizu
4,716,864 A 1/1988 Binder
4,726,331 A 2/1988 Oyaizu
4,754,727 A 7/1988 Hampton
4,762,097 A 8/1988 Baker
4,811,698 A 3/1989 Akasaka et al.
4,841,924 A 6/1989 Hampton et al.
4,878,461 A * 11/1989 Sapienza et al. ..... 123/90.15
4,889,086 A 12/1989 Scapecchi et al.
4,928,640 A 5/1990 Van Vuuren et al.
4,936,264 A 6/1990 Suga
4,960,084 A 10/1990 Akasaka et al.
4,976,229 A 12/1990 Charles
5,033,327 A 7/1991 Lichti et al.
5,056,478 A 10/1991 Ma
5,138,985 A 8/1992 Szodfridt
5,143,032 A 9/1992 Tortul
5,152,261 A 10/1992 Butterfield et al.
5,152,262 A 10/1992 Parker
5,163,872 A 11/1992 Niemiec et al.
5,167,206 A 12/1992 Suga
5,197,419 A 3/1993 Dingess
5,327,859 A 7/1994 Pierik et al.
5,467,748 A 11/1995 Stockhausen
5,560,329 A 10/1996 Hayman
5,606,941 A 3/1997 Trzmiel et al.
5,642,703 A 7/1997 Stockhausen et al.
5,671,920 A 9/1997 Acquaviva et al.
5,673,659 A 10/1997 Regueiro
5,713,317 A 2/1998 Yoshioka
5,857,437 A 1/1999 Yoshioka
5,876,295 A 3/1999 Young
5,934,263 A 8/1999 Russ et al.
5,950,582 A 9/1999 Stein
6,199,522 B1 3/2001 Regueiro
6,220,211 B1 4/2001 Line
6,247,437 B1 6/2001 Yamaguchi et al.
6,253,720 B1 7/2001 Lancefield et al.
6,505,586 B1 1/2003 Sato et al.
6,532,921 B2 3/2003 Sato et al.
6,650,994 B2 11/2003 Muhlberger
6,659,055 B2 12/2003 Park
6,668,546 B2 12/2003 Hayman et al.
6,700,920 B1 3/2004 Partyka
6,796,276 B2 9/2004 Kim
7,051,688 B2 5/2006 Lancefield
7,104,229 B2 9/2006 Mitchell
7,219,636 B2 5/2007 Sawada
7,228,829 B1 6/2007 Louie
7,540,267 B1 * 6/2009 Sellars ..... 123/90.31

* cited by examiner

APPARATUS AND METHODS FOR CONTINUOUS VARIABLE VALVE TIMING

BACKGROUND

1. Field of the Invention

The present inventions relate to internal combustion engines, and, more particularly, to apparatus and methods for phase shifting a driver gear and a driven gear connected by a timing belt.

2. Description of the Related Art

Various phase shift devices have been developed to alter the phase relationship between a driver gear such as a crankshaft gear and a driven gear such as a driven gear in mechanical communication by a timing belt in an internal combustion engine. Some phase shift devices may be mechanically complex. Other phase shift devices may vary the timing belt path length of the timing belt, which could limit the range over which the phase relationship may be altered, cause the device to bind, cause over-tensioning of the timing belt thereby causing the timing belt to fail, or otherwise function ineffectively. Accordingly, a need exists for improved apparatus and methods for regulating the phase relationship between a driver gear and a driven gear in communication by timing belt.

SUMMARY

A phase shift apparatus and methods in accordance with the present inventions may resolve many of the needs and shortcomings discussed above and will provide additional improvements and advantages that may be recognized by those of ordinary skill in the art upon study of the present disclosure.

The phase shift apparatus in various aspects includes a movable base continuously positionable between at least a base first position and a base second position. The phase shift apparatus in various aspects includes a first idler which defines a first idler axis of rotation and is disposed about the movable base and adapted to engage a first timing belt segment of a timing belt. The phase shift apparatus includes a second idler, which defines a second idler axis of rotation and is disposed about the movable base a fixed idler center-to-center distance from the first idler, with the second idler adapted to engage a second timing belt segment of the timing belt, in various aspects. The phase shift apparatus may include a path traversed by the first idler axis of rotation and the second idler axis of rotation as the movable base is positioned between at least the base first position and the base second position; the path configured such that a first segment path length of the first timing belt segment changes continuously in substantial correspondence to continuous changes in a second segment path length of the second timing belt segment to maintain a substantially constant timing belt path length.

The methods, in various aspects, include defining a path and altering the phase relationship between a driver gear and a driven gear connected by a timing belt by traversing a first idler engaging the timing belt and a second idler engaging the timing belt continuously along the path between at least a first position and a second position thereby maintaining the timing belt at a substantially constant length.

Other features and advantages of the present inventions will become apparent from the following detailed description and from the claims.

Figure 1:
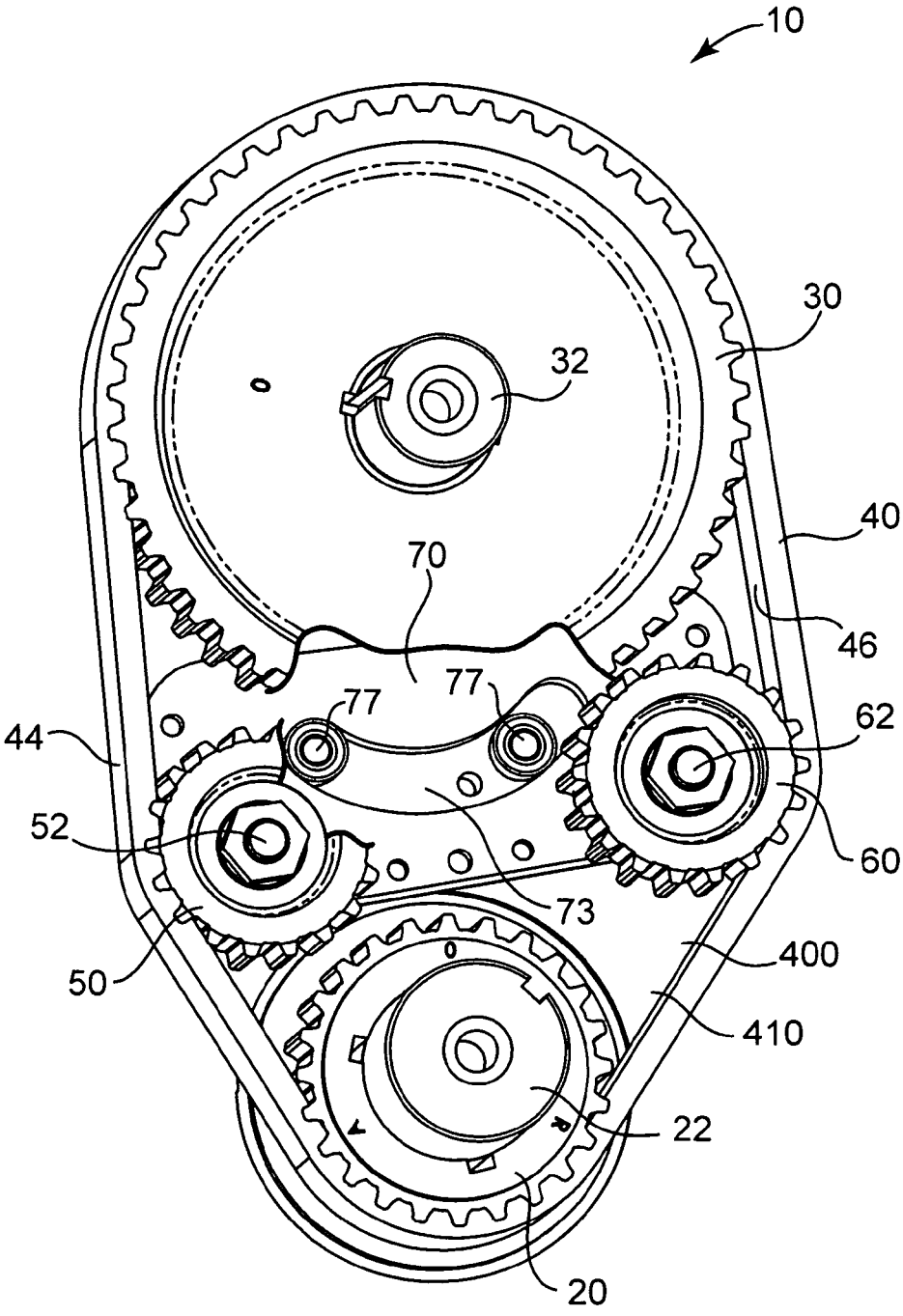
FIG. 1 illustrates by a cut-away perspective view an embodiment of a phase shift apparatus according to aspects of the present inventions.

The Figures are adapted to facilitate explanation of the present inventions. The extensions of the Figures with respect to number, position, relationship and dimensions of the parts to form the embodiment will be explained or will be within the skill of the art after the following description has been read and understood. Further, the dimensions and dimensional proportions to conform to specific force, weight, strength, flow and similar requirements will likewise be within the skill of the art after the following description has been read and understood.

Where used in the Figures, the same numerals designate the same or similar parts. Furthermore, when the terms "top," "bottom," "right," "left," "forward," "rear," "first," "second," "inside," "outside," and similar terms are used, the terms should be understood to reference only the structure shown in the drawings and utilized only to facilitate describing the illustrated embodiments.

DETAILED DESCRIPTION

A phase shift apparatus for use in an internal combustion engine is presented herein. The phase shift apparatus, in various aspects, is adapted to be continuously positionable between at least a first position and a second position in order to alter continuously the phase relationship between a driver gear and a driven gear connected by a timing belt. The phase shift apparatus includes a first idler and a second idler configured to engage the timing belt. As the phase shift apparatus is positioned between at least the first position and the second position, the first idler and the second idler are traversed in fixed relation to one another along a path wherein the path is configured to maintain a substantially constant timing belt path length of the timing belt.

Methods for positioning the first idler and the second idler in fixed relation to one another, describing the path, designing the phase shift apparatus, and calculating the resulting maximum phase shift between the driver gear and the driven gear are also presented herein.

The Figures generally illustrate various exemplary embodiments of the phase shift apparatus and methods. The particular exemplary embodiments illustrated in the Figures have been chosen for ease of explanation and understanding. These illustrated embodiments are not meant to limit the scope of coverage, but, instead, to assist in understanding the context of the language used in this specification and in the claims. Accordingly, variations of the phase shift apparatus and methods that differ from the illustrated embodiments may be encompassed by the appended claims.

With general reference to the Figures in the following, in various aspects, the internal combustion engine 400 includes a driver shaft 22 carrying a driver gear 20 and a driven shaft 32 carrying a driven gear 30. The driver shaft 22, in various aspects, may be a crankshaft, or other such shaft driven by pistons or other source of power, and the driven shaft 32, in various aspects, may be a camshaft, or other shaft as would be recognized by those of ordinary skill in the art upon study of this disclosure. The driver gear 20 and the driven gear 30 may be, for example, spur gears, sprockets, pulleys, toothed pulleys, or similar and combinations thereof, and the driver gear 20 and the driven gear 30 may be composed of steel, various metals and metal alloys and other materials, as would be recognized by those of ordinary skill in the art upon study of this disclosure.

The driver gear 20, in various aspects, bears a fixed rotational relationship with the driver shaft 22 upon which it is fixedly mounted, and, thus, the operation and position of the driver gear 20 may be directly related to, for example, piston position through the driver shaft 22. Likewise, in various aspects, the driven gear 30 bears a fixed rotational relationship with the driven shaft 22 upon which it is fixedly mounted, and, thus, the operation and position of the driven gear 30 may be directly related, for example, to valve position. The driven gear 30, in many aspects, is about twice the circumference of the driver gear 20.

The timing belt 40, in various aspects, connects the driver gear 20 and the driven gear 30 such that rotation of driver shaft 22 causes the simultaneous rotation of driven shaft 32. The timing belt 40 defines an internal periphery 46 and an external periphery 44, and, in various aspects, engages the driver gear 20 and the driven gear 30 with the internal periphery 46 as it passes about the driver gear 20 and the driven gear 30. The timing belt 40 may be a belt, a toothed belt with teeth disposed about the internal periphery 46, a chain, or otherwise configured to engage mechanically the driver gear 20 and the driven gear 30, as would be recognized by those of ordinary skill in the art upon study of this disclosure. In various aspects, the timing belt 40 may be composed of metal, rubber, various flexible synthetic materials, composite materials, and other materials and combinations of materials as would be recognized by those of ordinary skill in the art upon study of this disclosure.

In various aspects, the phase shift apparatus 10 includes the first idler 50, the second idler 60. The phase shift apparatus 10, in various aspects, is located intermediate of driver gear 20 and driven gear 30 at least partially within the internal periphery 46 of the timing belt 40 to allow the first idler 50 and the second idler 60 to engage mechanically the timing belt 40 along the internal periphery 46 in order to alter the phase relationship between the driver gear 20 and the driven gear 30. Accordingly, the first idler 50 and the second idler 60 may be sprocket gears, pulleys, toothed pulleys, or suchlike configured to engage mechanically the timing belt 40, and the first idler 50, the second idler 60, and may be made of metals or other materials or combinations of materials, as would be recognized by those of ordinary skill in the art upon study of this disclosure. The first idler 50 and the second idler 60 may be of similar geometry, i.e. same diameter, same number of teeth, and so forth in some aspects, while, in other aspects, the first idler 50 and the second idler 60 may have differing geometry.

The first idler 50, in various aspects, is rotatably secured about a first axle 52 to allow the first idler 50 to rotate as it engages the timing belt 40. The first idler 50 defines a first idler axis of rotation 142 about which the first idler 50 rotates, and, in various aspects, the first idler axis of rotation 142 corresponds to the centerline of the first axle 52. Similarly, in various aspects, the second idler 60 is rotatably secured about a second axle 62 to allow the second idler 60 to rotate as it engages the timing belt 40. The second idler 60 defines a second idler axis of rotation 144 about which the second idler 60 rotates, and, in various aspects, the second idler axis of rotation 144 corresponds to the centerline of the second axle 62.

The phase shift apparatus 10 maintains the first idler 50 and the second idler 60 in a substantially fixed geometric relationship with the first idler axis of rotation 142 set a substantially fixed idler center-to-center distance 132 apart from the second idler axis of rotation 144. As the phase shift apparatus 10 is positioned continuously between at least the first position 110 and the second position 120, the first idler 50 and the second idler 60 are traversed along path 100 in fixed geometric relation to one another to alter the phase relationship between the driver gear 20 and the driven gear 30. Accordingly, the first idler 50 and the second idler 60 are positioned in a unitary manner along the path 100 as the phase shift apparatus 10 is positioned between at least the first position 110 and the second position 120. In various aspects, the phase shift apparatus 10 may be positioned continuously between at least the first position 110 and the second position 120 so that the first idler 50 and the second idler 60 traverse the path 100 continuously and continuously alter the phase relationship between the driver gear 20 and the driven gear 30.

In some aspects, the phase shift apparatus 10 may be configured to cooperate with one or more positioning gears, actuator(s), armatures, or similar that may be provided to position the phase shift apparatus 10 and, hence, the first idler 50 and the second idler 60, as would be recognized by those of ordinary skill in the art upon study of this disclosure, in order to modulate the phase relationship between the driver gear 20 and the driven gear 30, and, hence, for example, between pistons and valves in response to various engine controls. For example, the phase relationship between pistons and valves may be modulated, in various aspects, in response to load on the engine, engine speed, fuel type, fuel-air mixture, and so forth. In some aspects, the phase relationship between the driver gear 20 and the driven gear 30 may be modulated as the thermodynamic cycle of the engine is altered between, for example, the Diesel cycle and the Otto cycle.

In various aspects, the phase shift apparatus 10 includes a movable base 70 with the first idler 50 and the second idler 60 secured thereto. In order to position the phase shift apparatus 10 between at least the first position 110 and the second position 120, the movable base 70 may be positioned between at least base first position 710 and a base second position 720. The first axle 52 and the second axle 62 are mounted fixedly to the movable base 70 so that the first idler 50 and the second idler 60 are oppositely disposed about the movable base 70 in various aspects. The first idler 50 and the second idler 60 remain in fixed geometric relation to one another as the movable base 70 is positioned continuously between at least the first base position 710 and the second base position 720 to traverse the first idler 50 and the second idler 60 along the path 100. In various aspects, the movable base 70 may be configured as a plate, bar, or suchlike with essentially unitary construction such that the first idler 50 and the second idler 60 are maintained in fixed relationship to one another. The movable base 70 may be made of metal such as steel or aluminum or other materials or combinations of materials, as would be recognized by those of ordinary skill in the art upon study of this disclosure.

The movable base 70, in various aspects, is movably secured about the engine block 410 or otherwise adapted to be continuously positionable between at least the first base position 710 and the second base position 720. Accordingly, the phase shift apparatus 10 is positioned between at least the first position 110 and the second position 120 by positioning the movable base 70 between at least the base first position 710 and the base second position 720, which traverses the first idler 50 and the second idler 60 along path 100.

In various aspects, portions of the movable base 70 are slidably retained within a slot 73 configured about the engine block 410. Posts 77 may be affixed to the engine block 410. The movable base 70 may be slid about posts 77 engaged within the slot 73 between at least the base first position 710 and the base second position 720 to position the phase shift apparatus 10 between at least the first position 110 and the second position 120. As the movable base 70 is slid between the base first position 710 and the base second position 720, the first idler 50 and the second idler 60 are traversed along path 100. In various aspects, the movable base 70 rotates about a movable base shaft 72, which is secured to the engine block 410, and the phase shift apparatus 10 may be positioned between at least the first position 110 and the second position 120 by rotation of the movable base 70 about the movable base shaft 72 between at least the base first position 710 and the base second position 720. Rotation of the movable base 70 between the base first position 710 and the base second position 720 traverses the first idler 50 and the second idler 60 along path 100. The movable base 70 may, in various other aspects, be configured and secured to the engine block 410 in other ways that would be recognized by those of ordinary skill in the art upon study of the present disclosure to traverse the first idler 50 and the second idler 60 continuously along the path 100 as the phase shift apparatus 10 is positioned continuously between at least the first position 110 and the second position 120.

In various aspects, the phase relationship between the driver gear 20 and the driven gear 30 is determined by the position of the movable base 70. For example, when the movable base 70 is positioned in the base first position 710 the distance between the first idler 50 and the driver gear 20 is decreased and the distance between second idler 60 and the driver gear 20 is increased. Accordingly, the phase relationship is shifted relatively, for example, to one in which driven gear 30 is advanced ahead of driver gear 20. In certain aspects, this alters the closing of the exhaust valves with respect to the position of the pistons. Similarly, when the movable base 70 is positioned in the base second position 720 to increase the distance between the first idler 50 and the driver gear 20 and to decrease the distance between second idler 60 and the driver gear 20, the phase relationship is shifted relatively, for example, to one in which driven gear 30 is retarded behind the driver gear 20. In certain aspects, this alters the closing of the exhaust valves with respect to the position of the pistons.

The first idler axis of rotation 142 and the second idler axis of rotation 144 traverse the path 100 as the phase shift apparatus 10 is positioned continuously between at least the first position 110 and the second position 120. In some aspects, the phase shift apparatus 10 may be positioned continuously between the first position 110 and the second position 120 through intermediate positions 115 bounded by the first position 110 and the second position 120 to traverse the first idler 50 and the second idler 60 continuously along the path 100. In some aspects, the path 100 may be an arc, but, in various aspects, the path 100 may have other non-linear (curved) shapes. The path 100 may be determined, and the phase shift apparatus 10 adapted to traverse the first idler axis of rotation 142 and the second idler axis of rotation 144 along the path 100.

In various aspects, the timing belt 40 defines a timing belt path length 45 which is the length of the path followed by the timing belt 40 as the timing belt 40 passes about the driver gear 20, the first idler 50, the driven gear 30, and the second idler 60. The timing belt 40 may be subdivided into a first timing belt segment 47 and a second timing belt segment 49. The first timing belt segment 47 is the portion of the timing belt 40 that passes generally from a driver gear medial point 29, which is generally the midpoint of the arc along which the timing belt 40 engages the driver gear 20, about the first idler 50, and thence to a driven gear medial point 39, which is generally the midpoint of the arc along which the timing belt 40 engages the driven gear 30 in various aspects. The first timing belt segment 47 defines a first segment path length 147, which is the length of the path followed by the first timing belt segment 47. The second timing belt segment 49 is the portion of the timing belt 40 that passes generally from the driven gear medial point 39, about the second idler 60, and thence to the driver gear medial point 29 in various aspects. The second timing belt segment 49 defines a second segment path length 149, which is the length of the path followed by the second timing belt segment 49. The sum of the first segment path length 147 and the second segment path length 149 would be equal to the timing belt path length 45 in various aspects. In various aspects, the timing belt path length 45, the first segment path length 147, and the second segment path length 149 may be defined as the pitch length along the belt pitch centerline or in other ways as would be recognized by those of ordinary skill in the art upon study of this disclosure.

In various aspects, the path 100 is defined such that the first segment length 147 of the first timing belt segment 47 changes in substantial correspondence to the second segment length 149 of the second timing belt segment 49 to maintain a substantially constant timing belt path length 45 of the timing belt 40 as phase shift apparatus 10 is positioned between at least the first position 110 and the second position 120. Because the timing belt length 45 is substantially constant as the phase shift apparatus 10 is positioned between at least the first position 110 and the second position 120, the timing belt 40 is not stretched substantially, and, accordingly, the tension in the timing belt 40 is not altered substantially. Although the interplay of the driver gear 20 and the driven gear 30 may induce changes in tension in the timing belt 40, the tension in the timing belt 40 may be said to be constant in that the phase shift apparatus 10 generally does not alter the tension in the timing belt 40 as the phase shift apparatus 10 is positioned between at least the first position 110 and the second position 120.

The timing belt path length 45 is substantially constant as the phase shift apparatus 10 is positioned continuously between at least the first position 110 and the second position 120 in various aspects. As the phase shift apparatus 10 is positioned at intermediate positions 115 between the first position 110 and the second position 120 in some aspects, the first idler 50 and the second idler 60 are traversed along path 100. In various aspects, the path 100 is adapted such that the first segment length 147 of the first timing belt segment 47 changes in substantial correspondence to the second segment length 149 of the second timing belt segment 49 as the first idler 50 and the second idler 60 engage the timing belt 40 to maintain a substantially constant timing belt path length 45 of the timing belt 40. Accordingly, the timing belt path length 45 of the timing belt 40 is substantially maintained throughout the range of intermediate positions 115 between the first position 110 and the second position 120, so that the phase relationship between the driver gear 20 and the driven gear 30 may be modulated continuously by the phase shift apparatus 10 over a range that may include varying amounts of positive and negative phase relationships.

Various illustrative implementations of the phase shift apparatus 10 and associated methods are illustrated in the Figures. FIG. 1 illustrates an embodiment of the phase shift apparatus 10. The driver gear 20 and the driven gear 30 are connected mechanically by the timing belt 40, as illustrated, so that rotation of the driver gear 20 by the driver shaft 22 causes rotation of the driven gear 30 and, hence, the driven shaft 32. In this embodiment, the phase shift apparatus 10 includes the first idler 50 and the second idler 60 disposed at opposing locations upon the movable base 70, and the movable base 70 slidably received in the slot 73. The first idler 50 and the second idler 60 rotate about first axle 52 and second axle 62, respectively, in this embodiment, and are configured to engage the inner periphery defined by the timing belt 40. By shifting the position of the movable base 70 between the base first position 710 and the base second position 720, the locations at which the first idler 50 and the second idler 60 engage the timing belt 40 are altered, which, in turn, alters the phase relationship between the driver gear 20 and the driven gear 30.

Figure 2A:
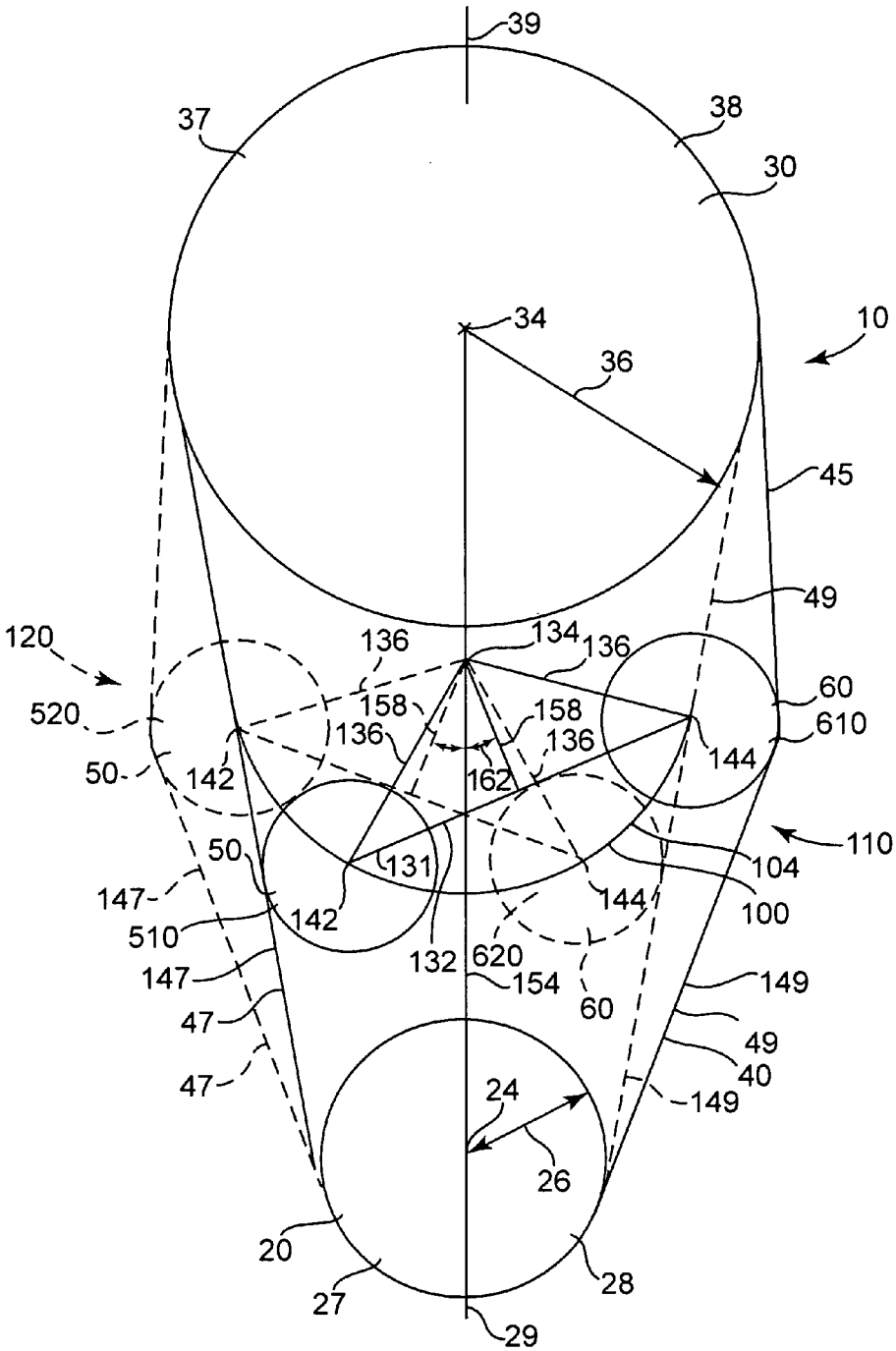
FIG. 2A illustrates by frontal view an embodiment of a phase shift apparatus according to aspects of the present inventions.

FIG. 2A illustrates the phase shift apparatus 10 in the first position 110 and the second position 120. In FIG. 2A, the first position 110 is illustrated in solid lines, and the second position 120 is illustrated in phantom. The first idler 50 may generally define the first idler axis of rotation 142 about which it rotates, and the second idler 60 may generally define the second idler axis of rotation 144 about which it rotates, as illustrated. The first idler axis of rotation 142 and the second idler axis of rotation 144 define an idler line 131, as illustrated. As illustrated, the first idler 50 and the second idler 60 are set at a substantially fixed idler center-to-center distance 132 measured along the idler line 131 between the first idler axis of rotation 142 and the second idler axis of rotation 144. In this embodiment, the first idler 50 and the second idler 60 are traversed along the path 100, which is configured as an arc having a constant pivot radius 136 about an idler pivot point 134. The first idler axis of rotation 142 and the second idler axis of rotation 144 traverse path 100 as the phase shift apparatus 10 is positioned between at least the first position 110 and the second position 120, as illustrated. As the phase shift apparatus 10 is positioned between at least the first position 110 and the second position 120, the first idler 50 is traversed between a first idler first position 510 and a first idler second position 520 and the second idler 60 is traversed between a second idler first position 610 and a second idler second position 620.

The driver gear 20 may define a driver gear axis 24 about which it rotates, and the driven gear 30 may define a driven gear axis 34 about which it rotates. In the embodiment of FIG. 2A, the idler pivot point 134 is disposed along a line 154 defined by the driver gear axis 24 and the driven gear axis 34. The idler pivot point 134, in this embodiment, lies generally closer to the driven gear axis 34 than to the driver gear axis 24, and the path 100 has a cam orientation 104 in which the path 100 opens toward the driven gear 30. In some variations of this illustrated embodiment, the idler pivot point 134 may lie generally within a driven gear radius 36 of the driven gear 30. In other embodiments, the idler pivot point 134 may lie generally closer to the driver gear axis 24 than the driven gear axis 34 along line 154 and could lie generally within a driver gear radius 26 of the driver gear 20, and the path 100 may have a crank orientation 100 in which the path 100 opens toward the driver gear 20. The path 100 in the embodiment of FIG. 2A is substantially symmetric about line 154. However, in other embodiments, the path 100 may be asymmetric about line 154.

An elevation line 158 may be defined to pass from the idler pivot point 134 and perpendicularly bisect the idler line 131 defined by the first idler axis of rotation 142 and the second idler axis of rotation 144 as illustrated in FIG. 2A. An off-symmetry angle (OSA) 162 may be defined as the angle between the elevation line 158 and the line 154, and is indicative of the amount of rotation of the first idler 50 and the second idler 60 between the first position 110 and the second position 120. The maximum off-symmetry angle 162 is the maximum off-symmetry angle 162 achieved over the range of motion of the phase shift apparatus 10. The off-symmetry angles 162 defined with the first idler 50 and the second idler 60 in the first position 110 and in the second position 120 may or may not be symmetrical in various aspects.

The line 154 may pass through the driver gear 20 and the driven gear 30 to define a driver gear left hemisphere 27, a driver gear right hemisphere 28, a driven gear left hemisphere 37, a driven gear right hemisphere 38, as illustrated in FIG. 2A. The driver gear medial point 29 and the driven gear medial point 39 are the midpoint of the arc along which the timing belt 40 engages the driver gear 20 and the driven gear 30, respectively, as illustrated in the Figure. Accordingly, the first timing belt segment 47 is the portion of the timing belt 40 that passes generally from the driver gear medial point 29, about the first idler 50, and thence to the driven gear medial point 39, and the first timing belt segment 47 defines the first segment path length 147, as illustrated. The second timing belt segment 49 is the portion of the timing belt 40 that passes generally from the driven gear medial point 39, about the second idler 60, and thence to the driver gear medial point 29, and the second timing belt segment 49 defines the second segment path length 149, as illustrated. As illustrated, the first timing belt segment 47 engages the driver gear left hemisphere 27 and the driven gear left hemisphere 37, and the second timing belt segment 49 engages the driver gear right hemisphere 28 and the driven gear right hemisphere 38. The driver gear medial point 29 and the driven gear medial point 39 in this embodiment lie substantially on line 154. Those of ordinary skill in the art upon study of this disclosure would recognize that the driver gear medial point 29 and the driven gear medial point 39 may be otherwise disposed about the driver gear 20 and the driven gear 30 to define the first timing belt segment 47 and the second timing belt segment 49 in various embodiments.

Figure 2B:
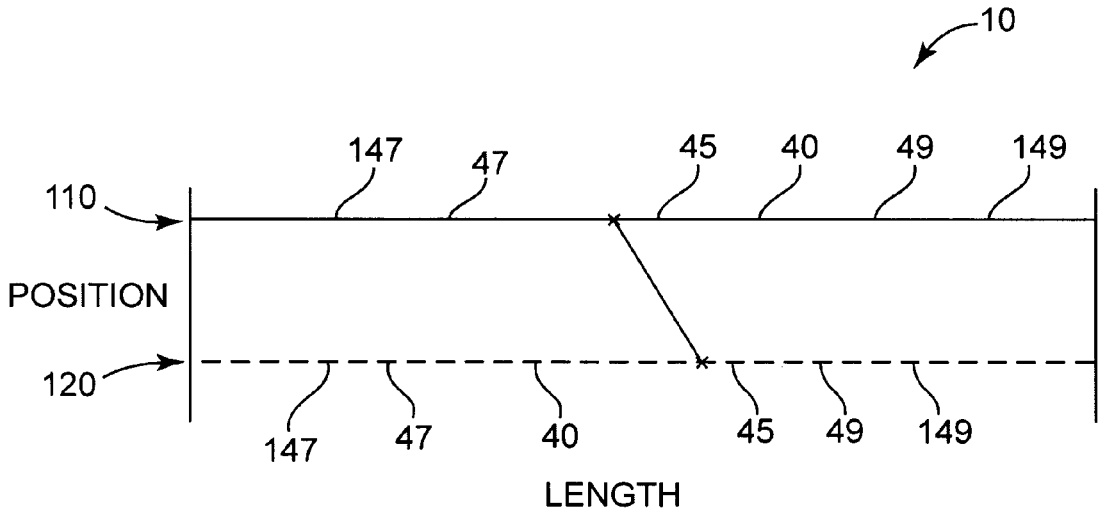
FIG. 2B illustrates by graphical view features of the timing belt generally corresponding to FIG. 2A.

FIG. 2B illustrates the timing belt path length 45 of the timing belt 40 as well as the first segment path length 147 of the first timing belt segment 47 and the second segment path length 149 of the second timing belt segment 49 as the phase shift apparatus 10 is placed in the first position 110 and in the second position 120. The first segment path length 147 and the second segment path length 149 are inclusive of arc lengths about driver gear 20 and driven gear 30 within corresponding hemispheres in this illustration. As the phase shift apparatus 10 is positioned from the first position 110 into the second position 120, first idler 50 and the second idler 60 traverse path 100 such that the first segment path length 147 of the first timing belt segment 47 continuously increases, and the second segment path length 149 of the second timing belt segment 49 continuously decreases in substantial correspondence, so that the overall timing belt path length 45 of the timing belt 40 remains substantially constant, as illustrated. Similarly, as the phase shift apparatus 10 is positioned from the second position 120 into the first position 110, the first segment path length 147 of the first timing belt segment 47 continuously decreases, and the second segment path length 149 of the second timing belt segment 49 continuously increases in substantial correspondence, so that the overall timing belt path length 45 of the timing belt 40 remains substantially constant, as illustrated.

As illustrated in FIG. 2B, the first segment path length 147 of the first timing belt segment 47 and the second segment path length 149 of the second timing belt segment 49 change substantially linearly at substantially the same rate (e.g. line slope) as the phase shift apparatus 10 is positioned between at least the first position 110 and the second position 120. Because the first segment path length 147 of the first timing belt segment 47 and the second segment path length 149 of the second timing belt segment 49 change substantially linearly at substantially the same rate, increases in first segment path length 147 of the first timing belt segment 47 correspond to decreases in second segment path length 149 of the second timing belt segment 49, and visa versa, as the phase shift apparatus 10 is positioned at intermediate positions 115 between the first position 110 and the second position 120. This may facilitate positioning the first idler 50 and the second idler 60 between the first position 110, the second position 120, and at intermediate positions 115. The rotation of the timing belt 40 on the various gears may facilitate the distribution of lengths between the first timing belt segment 47 and the second timing belt segment 49 as the phase shift apparatus 10 traverses the first idler 50 and the second idler 60 along the path 100. Changes in tension in portions of the timing belt 40 due to changes in the biasing of the first idler 50 and/or the second idler 60 against the timing belt 40 may be substantially eliminated to facilitate the continuous positioning of the first idler 50 and the second idler 60 continuously along path 100 as the phase shift apparatus 10 is positioned continuously between at least the first position 110 and the second position 120.

Figure 3A:
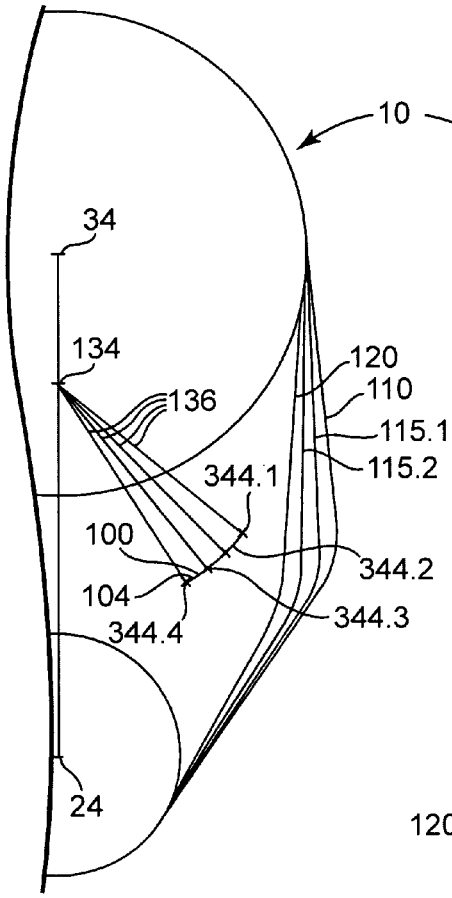
FIG. 3A illustrates by graphical view portions of an embodiment of the phase shift apparatus according to aspects of the present inventions.
Figure 3B:
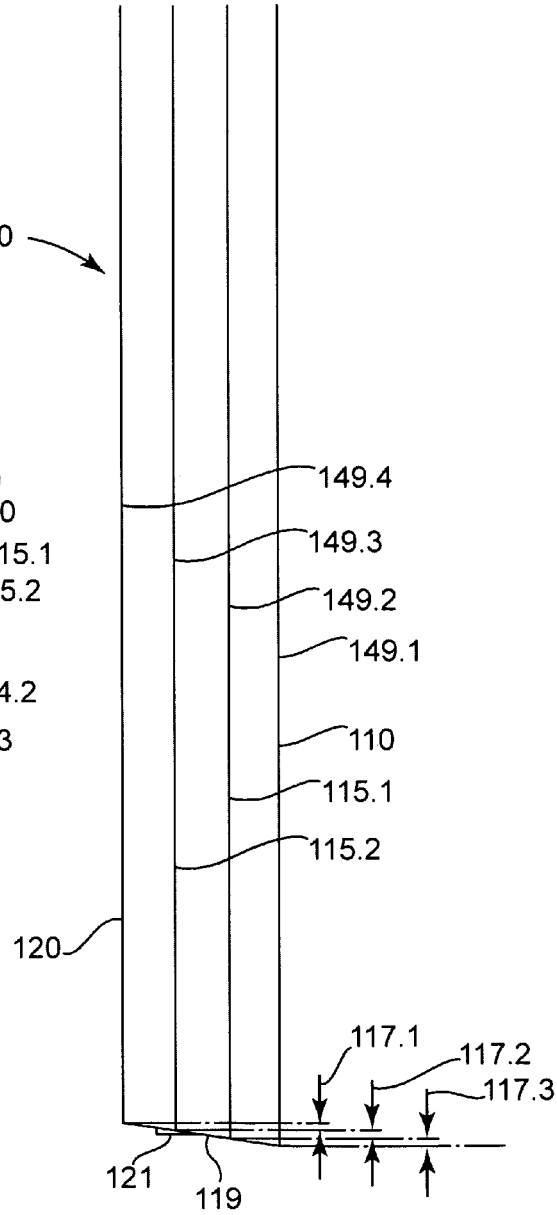
FIG. 3B illustrates by a graphical view features of the timing belt generally corresponding to FIG. 3A.

The path 100 and other geometric characteristics of the phase shift apparatus 10 that include, in various embodiments, the idler center-to-center distance 132, the distance of the idler pivot point 134 from driven gear axis 34 on the line 154, the pivot radius 136, and the maximum off-symmetry angle 162, are chosen such that the increase in the first segment path length 147 of the first timing belt segment 47 substantially corresponds to the decrease in the second segment path length 149 of the second timing belt segment 49 and visa versa, as illustrated in FIG. 2B. The first segment path length 147 and the second segment path length 149 change substantially linearly at substantially the same rate as the phase shift apparatus 10 is positioned continuously between at least the first position 110 and the second position 120 to traverse the first idler 50 and the second idler 60 continuously along path 100. FIGS. 3A and 3B further illustrate this point.

In FIG. 3A, the second timing belt segment 49 is illustrated with the phase shift apparatus 10 in the first position 110, the second position 120, and in intermediate positions 115.1, 115.2 for a particular embodiment of the phase shift apparatus 10. Second idler axis of rotation positions 344.1, 344.2, 344.3, 344.4 that correspond to the first position 110, the intermediate positions 115.1, 115.2, and the second position 120 respectively are also illustrated in FIG. 3A. The second idler axis of rotation positions 344.1, 344.2, 344.3, 344.4 lie along the path 100, which has a cam orientation 104, as illustrated. The path 100, and, hence, the second idler axis of rotation positions 344.1, 344.2, 344.3, 344.4 are located at pivot radius 136 from the idler pivot point 134, as illustrated.

In FIG. 3B, the second segment path lengths 149.1, 149.2, 149.3, 149.4 of the second timing belt segment 49 and corresponding length changes 117.1, 117.2, 117.3 are shown for the first position 110, the intermediate positions 115.1, 115.2, and the second position 120, respectively, of the phase shift apparatus 10. The second segment path length 149 of the second timing belt segment 49 changes continuously in a substantially linear manner in this implementation, as indicated by the linear relationship 119 with slope 121 as the phase shift apparatus 10 is continuously positioned between the first position 110 and the second position 120 and the first idler 50 and the second idler 60 are continuously traversed along path 100. Although not shown in FIG. 3B, the first segment path length 147 of the first timing belt segment 47 changes substantially according to the linear relationship 119 with slope 121 in correspondence to the second segment path length 149 so that the timing belt path length 45 remains substantially constant as the phase shift apparatus 10 is continuously positioned between at least the first position 110 and the second position 120.

Figure 6:
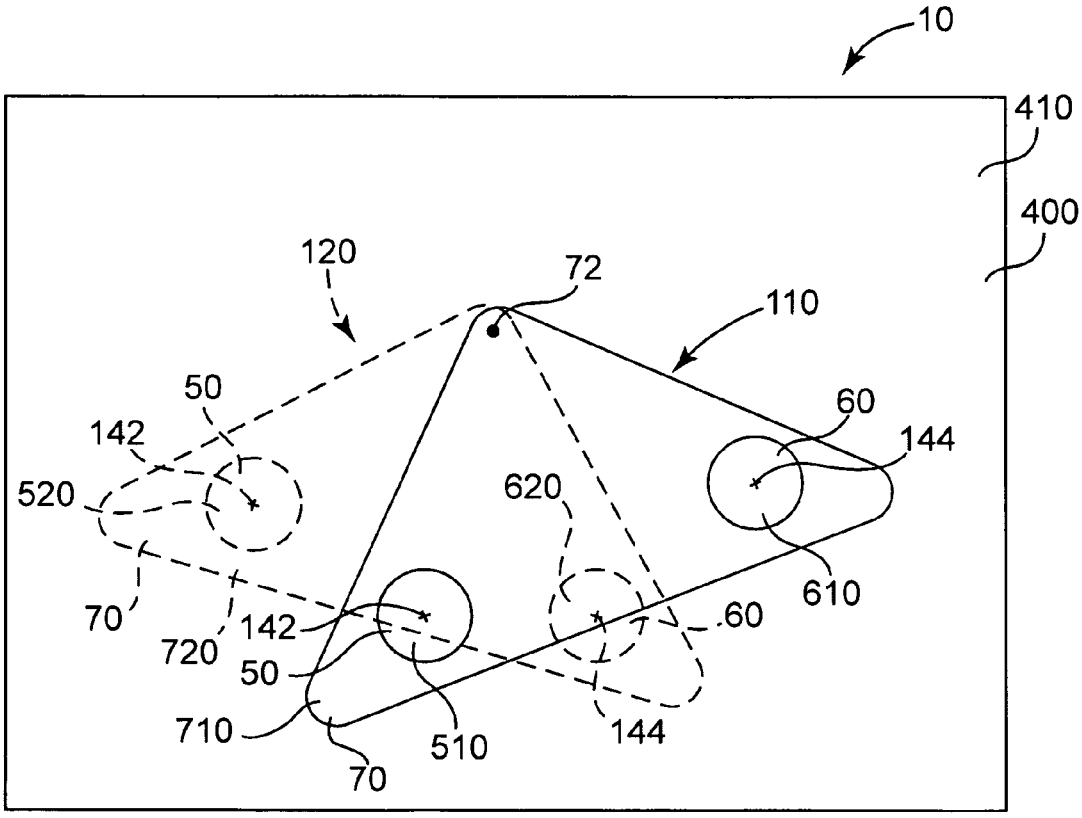
FIG. 6 illustrates schematically an embodiment of portions of the phase shift apparatus according to aspects of the present inventions.

FIG. 6 illustrates another embodiment of the phase shift apparatus 10. In this embodiment, the first idler 50 and the second idler 60 are disposed about the movable base 70. The movable base 70 is rotatably secured to the engine block 410 of internal combustion engine 400 by movable base shaft 72 in this embodiment. The movable base 70, as illustrated, may then rotate about the movable base shaft 72 between at least the base first position 710 and the base second position 720 (shown in phantom) to position the phase shift apparatus 10 between at least the first position 110 and the second position 120. As the phase shift apparatus 10 is positioned between at least the first position 110 and the second position 120, the first idler 50 is traversed between at least the first idler first position 510 and the first idler second position 520 and the second idler 60 is traversed between at least the second idler first position 610 and the second idler second position 620.

Methods, in various aspects, may include continuously altering the phase relationship between a driver gear 20 and a driven gear 30 by traversing the first idler 50 and the second idler 60 along the path 100, the first idler 50 and the second idler 60 engaging the timing belt 40, and changing linearly the first segment path length 147 of the first timing belt segment 47 in a continuous manner in substantial correspondence with linear change in the second segment path length 149 of the second timing belt segment 49 such that the timing belt path length 45 of the timing belt 40 remains substantially constant. The methods may include traversing the first idler 50 and the second idler 60 along path 100 by positioning the phase shift apparatus 10 between the first position 110 and the second position 120 and maintaining the first idler 50 in fixed geometric relation with the second idler 60. In various aspects, increasing the first segment path length 147 of the first timing belt segment 47 and correspondingly decreasing the second segment path length 149 of the second timing belt segment 49 in a continuous manner by traversing the first idler 50 and the second idler 60 continuously along path 100 may be included in the methods. In various aspects, decreasing the first segment path length 147 of the first timing belt segment 47 and correspondingly increasing the second segment path length 149 of the second timing belt segment 49 in a continuous manner by traversing the first idler 50 and the second idler 60 along path 100 may be included in the methods.

In various aspects, methods may be provided for defining the path 100. The methods may include adapting the phase shift apparatus 10 to traverse the first idler 50 and the second idler 60 along the path 100. The methods may include specifying the configurations of the timing belt 40, the driver gear 20, the driven gear 30, the first idler 50, and the second idler 60 and determining the idler center-to-center distance 132, the distance of the idler pivot point 134 from driven gear axis 34 on the line 154, the pivot radius 136, and the maximum off-symmetry angle 162. In some aspects, an optimization method may be used to determine the idler center-to-center distance 132, the distance of the idler pivot point 134 from driven gear axis 34 on the line 154, the pivot radius 136, and the maximum off-symmetry angle 162. The path 100 may be defined, at least in part, by arcing the pivot radius 136 about the pivot point 134.

EXAMPLES

A further understanding may be obtained by reference to certain specific examples, which are provided herein for the purpose of illustration only and are not intended to be limiting unless otherwise specified. Note that at least some of the values given in these examples are computationally derived, and may be rounded, truncated or otherwise refined to engineering tolerances in physical implementations, as would be readily recognized by those of ordinary skill in the art upon study of this disclosure.

Example 1

Figure 4A:
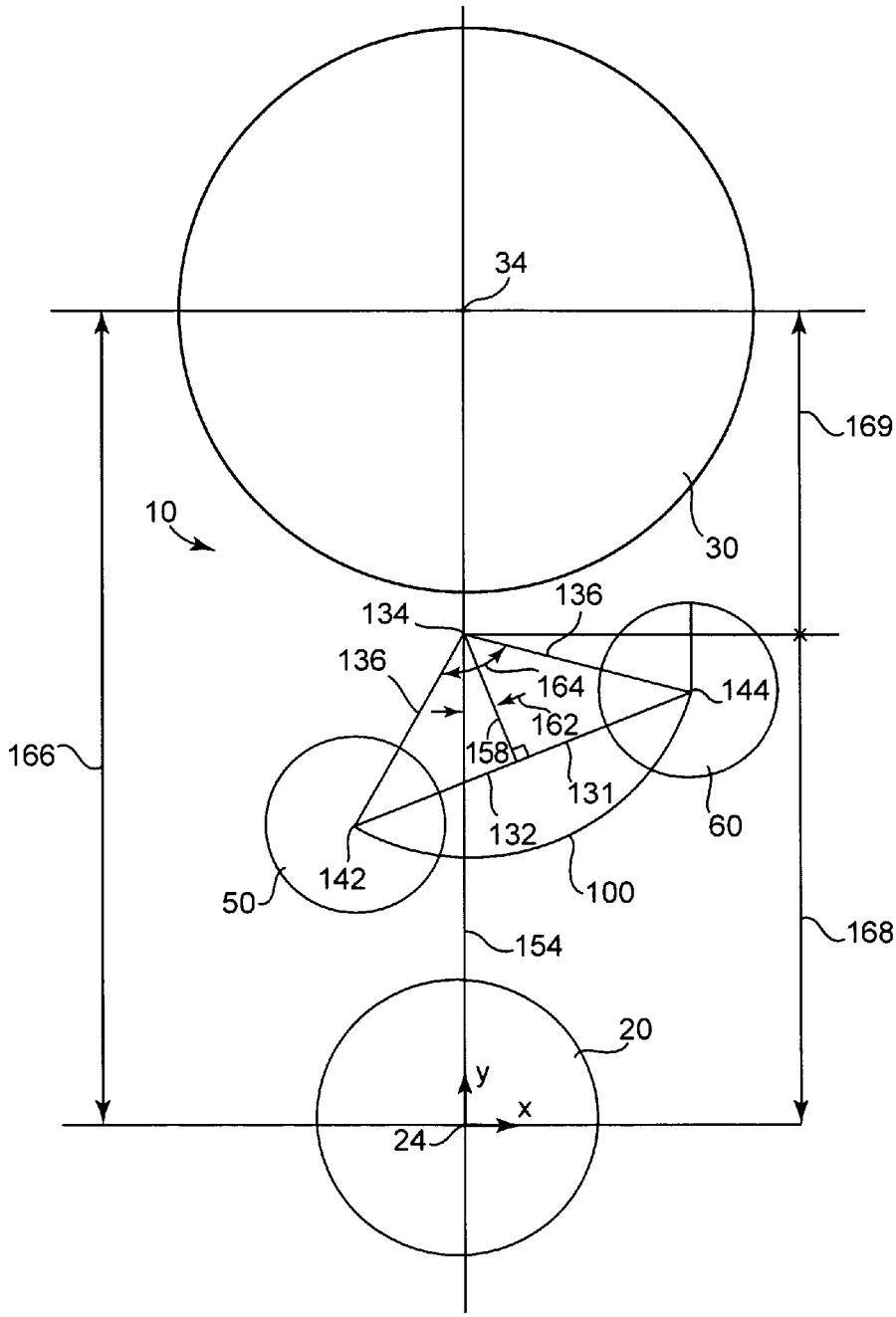
FIG. 4A illustrates by graphical view portions of an embodiment of the phase shift apparatus according to aspects of the present inventions.

In Example 1, the configuration of the timing belt 40 was specified as indicated in Table 1-1 and the driver gear 20, the driven gear 30, the first idler 50 and the second idler 60, and the driven gear axis to driver gear axis distance 166 were specified as indicated in Table 1-2. As indicated in Table 1-3, initial values that describe the geometry of the phase shift apparatus 10 were chosen, and these values were refined by iteration subject to the constraints given in Table 1-4. The geometric parameters include the idler center-to-center distance 132, distance of the idler pivot point from driver gear axis 168, the pivot radius 136, and the maximum off-symmetry angle 162. The distance of the idler pivot point from the driver gear axis 168 and the distance of idler pivot point from driven gear axis 169 are illustrated in FIG. 4A. Also illustrated in FIG. 4A is the driven gear axis to driver gear axis distance 166.

TABLE 1-1

| Timing Belt Configuration | |
|---|---|
| Number of teeth | 70 |
| Tooth pitch | 8 mm |
| Radial offset from gear tooth to belt pitch centerline | 0.02700 in. |

TABLE 1-2

| Gear Configurations | |
|---|---|
| | number of teeth |
| Driver Gear | 24 |
| Driven Gear | 48 |
| Idler | 18 |
| Driven gear axis to driver gear axis distance | 4.968 (in) |
| Orientation | Driven |

TABLE 1-3

| Design Optimization Parameters | |
|---|---|
| Idler Center-To-Center Distance | 3.00 (in) |
| Distance of Idler Pivot Point from driver gear axis (Above [+] (Below [−]) (in) | 3.5 (in) |
| Pivot radius | 2.20 (in) |
| Maximum Off-symmetry angle | 5.00 (degrees) |

TABLE I-4

| Optimization Constraints | |
|---|---|
| Minimum Clearance Between Idlers, Driver Gear, and Driven Gear (for prevention of collisions) | ≧0.030 (in) |
| Minimum Belt Engagement on Idlers to Prevent Disengagement from Idlers | ≧0.001 (in) |
| Minimum Belt Engagement on Driver Gear (Teeth) | ≧6 |
| Maximum Allowable Off-symmetry angle Induced Variation in Timing Belt Pitch Centerline Length | ≦0.0001 (in) |

An exemplary Microsoft Excel® spreadsheet for calculation of the design optimization parameters, which may include the idler center-to-center distance 132, the distance of the idler pivot point 134 from driven gear axis 34, the distance between idler pivot point 134 and idler axes 142,144, and the maximum off-symmetry angle 162, and the resulting maximum phase shift between the driver gear 20 and the driven gear 30 is given in Table A-1, Table A-2, and Table A-3 in the Appendix Table A-1 illustrates the spreadsheet, and the corresponding formulae for the various cells within the spreadsheet are given in Table A-2. The design optimization parameters in Table 1-3, which include the idler center-to-center distance 132, the distance of the idler pivot point 134 from driven gear axis 34, the distance between idler pivot point 134 and idler axis, and the maximum off-symmetry angle 162, were entered into cells B19, B20, B21, and B22, respectively. [See Table A-1—note that the values in Table A-1 are the initial non-optimized values] The solution was found by non-linear optimization of the idler center-to-center distance 132, the distance of the idler pivot point 134 from driven gear axis 34, the distance between idler pivot point 134 and idler axes 142, 144, and the maximum off-symmetry angle 162 subject to the constraints given in Table A-3. A non-linear optimization technique was used to compute the optimized values. This optimization technique employed a conjugate gradient method using centered difference approximations to the derivatives and quadratic estimates. Because of the non-linear nature of the problem, other solutions may exist that satisfy the constraints. As will be readily recognized by those of ordinary skill in the art upon study of this disclosure, other methods of solution may be utilized, and the methods of solution may be implemented using other computational means including symbolic algebra programs, computer codes such as C and FORTRAN, and various other spreadsheets.

Some results of the computation are presented in Table 1-5, Table 1-6, and Table 1-7. Table 1-5, lists the optimal idler center-to-center distance 132, the distance of the idler pivot point 134 above the driver gear axis 24 along line 154, the distance between the idler axis and the idler pivot point 134, and the maximum off-symmetry angle 162, the pivot point angle 164, and the distance of the idler pivot point 134 from the driven gear axis 34.

TABLE 1-5

| Optimized Design Parameters | |
|---|---|
| Idler Center-To-Center Distance | 3.21702 (in) |
| Distance of Idler Pivot Point Above (+) [Below(−)] Diver Gear Axis | 3.68172 (in) |
| Pivot radius | 2.34623 (in) |
| Maximum Off-symmetry angle | 9.77100 (degrees) |
| Pivot-Point Angle Between Idler Pulley Axes | 86.56154 (degrees) |
| Distance of Idler Pivot Point from driven gear axis (Above [+] (Below [−]) | −1.28628 (in) |

The path 100 is described in Table 1-6 which lists the x-y coordinates of the loci of the first idler axis of rotation 142 and the second idler axis of rotation 142 over the range of off-symmetry angles 162 between zero and the maximum off-symmetry angle 162. The x and y coordinates originate at the driver gear axis 24, with the positive x direction and the positive y directions as indicated in FIG. 4A.

TABLE 1-6

| Idler Axis Locations | | | | | |
|---|---|---|---|---|---|
| First Idler Axis of Rotation | | | Second Idler Axis of Rotation | | |
| x (in) | y (in) | OSA (deg) | x(in) | y(in) | OSA (deg) |
| −1.87505 | 2.27142 | 9.771 | 1.29530 | 1.72545 | 9.771 |
| −1.82587 | 2.20829 | 7.817 | 1.36126 | 1.77076 | 7.817 |
| −1.77457 | 2.14689 | 5.863 | 1.42563 | 1.81829 | 5.863 |
| −1.72119 | 2.08727 | 3.908 | 1.48835 | 1.86799 | 3.908 |
| −1.66582 | 2.02950 | 1.954 | 1.54933 | 1.91980 | 1.954 |
| −1.60851 | 1.97366 | 0.000 | 1.60851 | 1.97366 | 0.000 |

Table 1-7 gives the length of the first timing belt segment 47 and the length of the second timing belt segment 49 as well as the total length of the timing belt 40 for various off-symmetry angles 162. In Example 1, the length of the first timing belt segment 47 changes in correspondence to the length of the second timing belt segment 49 so that the total length of the timing belt 40 varies by less than 1/10,000 of an inch as per the specified constraint in this example. The phase relationship results are also given in Table 1-6. In Example 1, the maximum phase angle rotational skew between the driver gear 20 and the driven gear is 5.7247°.

TABLE 1-7

| OSA (degree) | 9.771 | 7.817 | 5.863 | 3.908 | 1.954 | 0.000 |
|---|---|---|---|---|---|---|
| Length First Timing Belt Segment (in) | 11.14388 | 11.12073 | 11.09701 | 11.07285 | 11.04835 | 11.02367 |
| Length Second Timing Belt Segment (in) | 10.90347 | 10.92642 | 10.95013 | 10.97438 | 10.99896 | 11.02367 |
| Total Timing Belt Length (in) | 22.04734 | 22.04714 | 22.04714 | 22.04723 | 22.04731 | 22.04734 |
| Total phase angle rotational skew (degree) | 5.72470 | 4.62710 | 3.49768 | 2.34473 | 1.17623 | 0.00000 |

Figure 4B:
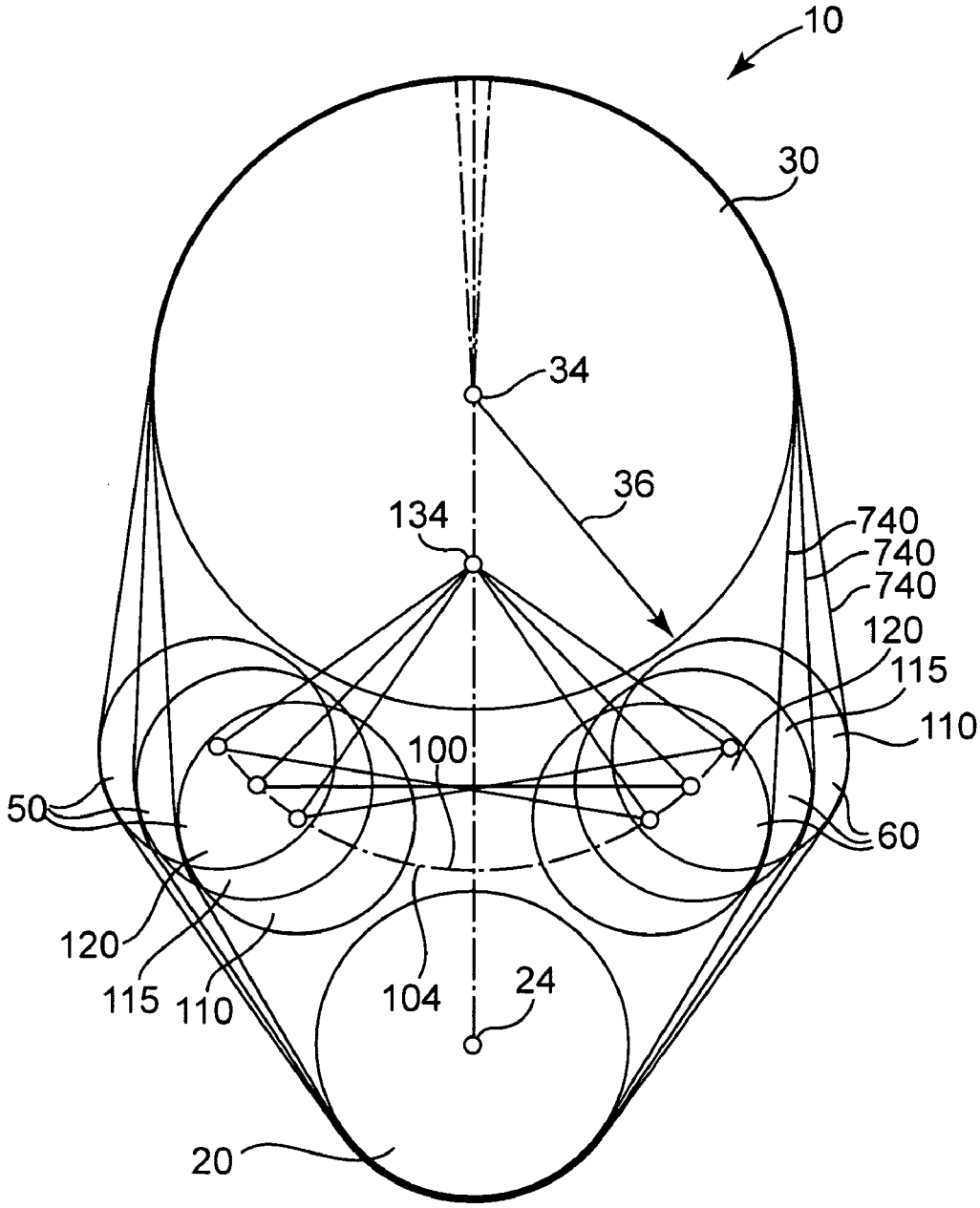
FIG. 4B illustrates by frontal view portions of an embodiment of the phase shift apparatus generally corresponding to FIG. 4A.

The results of the computation are presented graphically in FIG. 4B. FIG. 4B illustrates the first idler 50 and the second idler 60 with the phase shift apparatus 10 in the first position 110, in the second position 120, and in intermediate position 115 and the corresponding belt pitch centerline path 740 of the timing belt 40. The first idler 50 and the second idler 60 clear the driver gear 20 and the driven gear 30, as illustrated. The path 100 has a driven orientation 104 in this example, and the idler pivot point 134 lies within the driven gear radius 36 of the driven gear 30. Other optimized values that describe the phase shift apparatus 10 and its operation are also obtained from this computation, as indicated in Table A-1 of the Appendix.

Example 2

In Example 2, the timing belt 40 configuration was specified as indicated in Table 2-1, and the driver gear, the driven gear 30, the first idler 50 and the second idler 60 were specified as indicated in Table 2-2. As indicated in Table 2-3, initial values that describe the geometry of the phase shift apparatus 10 were chosen, and these values were refined by iteration subject to the constraints given in Table 2-4.

TABLE 2-1

| Timing Belt Configuration | |
|---|---|
| Number of teeth | 70 |
| Tooth pitch | 8 mm |
| Radial offset from gear tooth to belt pitch centerline | 0.02700 in. |

TABLE 2-2

| Gear Configurations | |
|---|---|
| | number of teeth |
| Driver Gear | 24 |
| Driven Gear | 48 |
| Idler | 18 |
| Driven gear axis to driver gear axis distance | 4.968 (in) |
| Orientation | Driver |

TABLE 2-3

| Design Optimization Parameters | |
|---|---|
| Idler Center-To-Center Distance | 3.00 (in) |
| Distance of Idler Pivot Point from driver gear axis (Above [+] (Below [−]) (in) | 1.20 (in) |
| Pivot radius | 1.60 (in) |
| Maximum Off-symmetry angle | 12.00 (degrees) |

TABLE 2-4

| Optimization Constraints | |
|---|---|
| Minimum Clearance Between Idlers, Driver Gear, and Driven Gear (for prevention of collisions) | ≧0.030 (in) |
| Minimum Belt Engagement on Idlers to Prevent Disengagement from Idlers | ≧0.001 (in) |
| Minimum Belt Engagement on Driver Gear (Teeth) | ≧6 |
| Maximum Allowable Off-symmetry angle Induced Variation in Timing Belt Pitch Centerline Length | ≦0.0001 (in) |

Some results of the computation are presented in Table 2-5, Table 2-6, and Table 2-7. Table 2-5, lists the optimal center-to-center distance between the first idler axis and the second idler axis, the distance of the idler pivot point 134 with respect to the driver gear axis 24, the distance between the idler axis and the idler pivot point 134, and the maximum off-symmetry angle 162, the pivot point angle 164, and the distance of the idler pivot point 134 from the driven gear axis 34.

TABLE 2-5

| Optimized Design Parameters | |
|---|---|
| Idler Center-To-Center Distance | 3.04493 (in) |
| Distance of Idler Pivot Point Above (+) [Below(−)] Driver Gear Axis | 1.19308 (in) |
| Pivot radius | 1.59757 (in) |
| Maximum Off-symmetry angle | 12.27447 (degree) |
| Pivot-Point Angle Between Idler Pulley Axes (deg) | 144.72241 (degree) |
| Distance of Idler Pivot Point from driven gear axis (Above [+] (Below [−]) | −3.77492 (in) |

The path 100 is described in Table 2-6, which gives the loci of the first idler axis of rotation 142 and the second idler axis of rotation 142. The x and y coordinates are measured from the driver axis of rotation.

TABLE 2-6

| Idler Axis Locations | | | | | |
|---|---|---|---|---|---|
| First Idler Axis of Rotation | | | Second Idler Axis of Rotation | | |
| x (in) | y (in) | OSA (deg) | x (in) | y (in) | OSA (deg) |
| −1.59057 | 1.34243 | 12.274 | 1.38475 | 1.98977 | 12.274 |
| −1.58272 | 1.41042 | 9.820 | 1.41760 | 1.92972 | 9.820 |
| −1.57196 | 1.47801 | 7.365 | 1.44785 | 1.86833 | 7.365 |
| −1.55831 | 1.54508 | 4.910 | 1.47544 | 1.80569 | 4.910 |
| −1.54180 | 1.61151 | 2.455 | 1.50033 | 1.74193 | 2.455 |
| −1.52246 | 1.67716 | 0.000 | 1.52246 | 1.67716 | 0.000 |

Table 2-7 gives the length of the first timing belt segment 47 and the length of the second timing belt segment 49 as well as the total length of the timing belt 40 for various off-symmetry angles 162. In Example 2, the length of the first timing belt segment 47 changes in correspondence to the length of the second timing belt segment 49 so that the total length of the timing belt 40 varies by less than 1/10,000 of an inch as per the specified constraint in this example. The phase relationship results are also given in Table 2-6. In Example 2, the maximum phase angle rotational skew between the driver gear 20 and the driven gear 30 is 5.41704°.

TABLE 2-7

| | | | | | | |
|---|---|---|---|---|---|---|
| OSA (degree) | 12.274 | 9.820 | 7.365 | 4.910 | 2.455 | 0.000 |
| Length First Timing Belt Segment (in) | 11.13742 | 11.11557 | 11.09313 | 11.07023 | 11.04701 | 11.02361 |
| Length Second Timing Belt Segment (in) | 10.90993 | 10.93161 | 10.95401 | 10.97694 | 11.00020 | 11.02361 |
| Total Timing Belt Length (in) | 22.04734 | 22.04718 | 22.04714 | 22.04717 | 22.04720 | 22.04722 |
| Total phase angle rotational skew (degree) | 5.41704 | 4.38061 | 3.31281 | 2.22156 | 1.11468 | 0.00000 |

Figure 5:
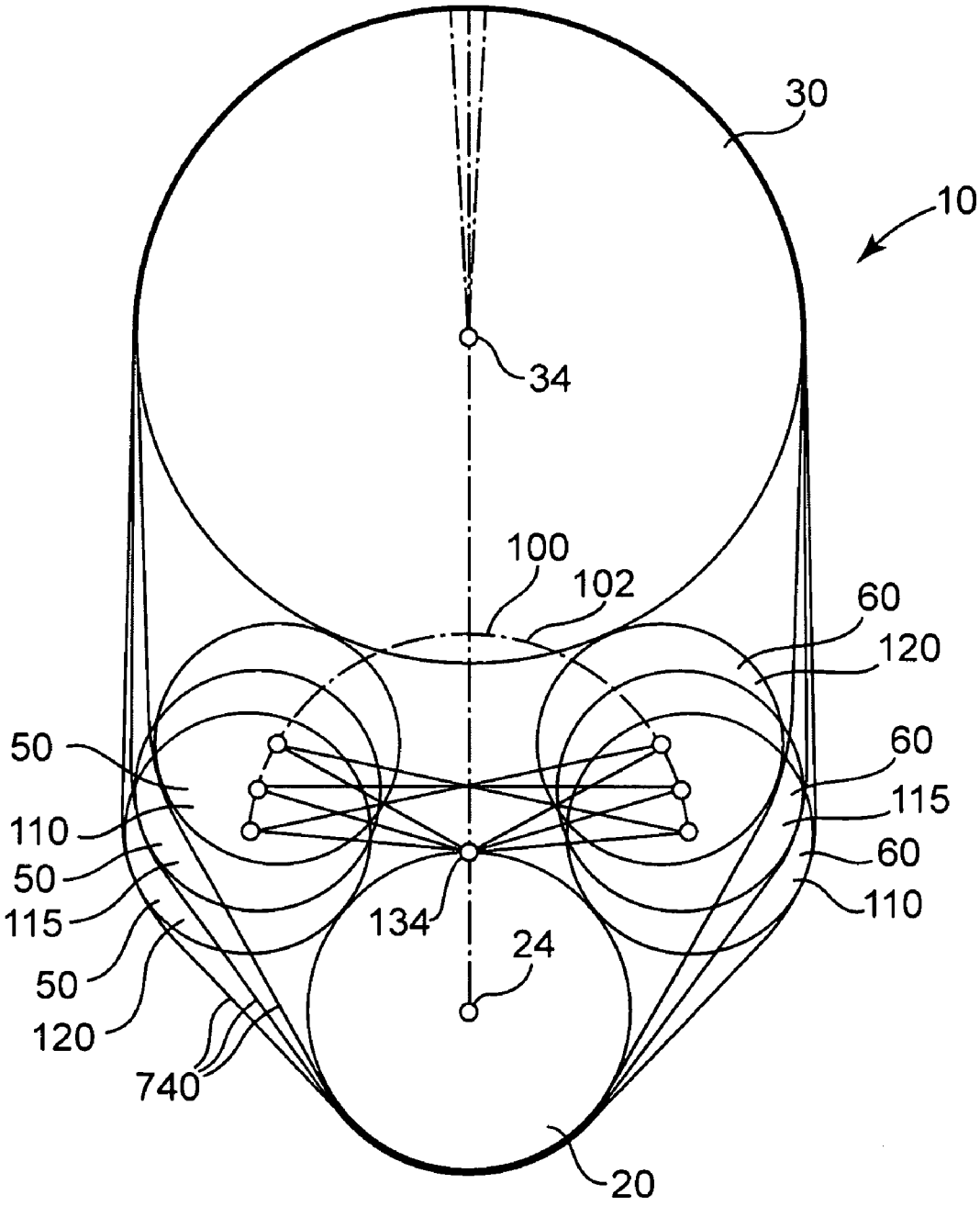
FIG. 5 illustrates by frontal view portions of an embodiment of the phase shift apparatus according to aspects of the present inventions.

The results of the computation are presented graphically in FIG. 5. FIG. 5 illustrates the first idler 50 and the second idler 60 with the phase shift apparatus 10 in the first position 110, in the second position 120, and in intermediate position 115, and the corresponding pitch centerline path 740 of the timing belt 40. As illustrated, the first idler 50 and the second idler 60 clear the driver gear 20 and the driven gear 30. The path 100 has a driver orientation 102 in this example, and the idler pivot point 134 lies proximate the driver gear radius 26 of the driver gear 20.

The foregoing discussion and the Appendix disclose and describe merely exemplary implementations. Upon study of the specification, one of ordinary skill in the art will readily recognize from such discussion, and from the accompanying figures and claims, that various changes, modifications and variations can be made therein without departing from the spirit and scope of the inventions as defined in the following claims.

Appendix A

TABLE A-1

| | A | B | C | D | E | F | G | H |
|---|---|---|---|---|---|---|---|---|
| | | | | Timing Belt Configuration . . . | | | | |
| 3 | | Teeth | P.L. (mm) | P.L. (in) | | | | |
| 4 | | 70 | 560 | 22.04724 | Belt Pitch-Centerline Length | | | |
| 5 | | 8 | Tooth Pitch (mm) | | | | | |
| 6 | | 0.02700 | Radial Offset from Pulley Tooth-Tip to Belt Pitch-Centerline | | | | | |
| 7 | | | | | | | | |
| | | | | Gear Configurations and Radial Extents (in) . . . | | | | |
| 10 | | Teeth | Pitch CL | Tooth-Tip | | | | |
| 11 | | 24 | 1.20306 | 1.17606 | Driver Gear (Piston Driver) | | | |
| 12 | | 48 | 2.40612 | 2.37912 | Driven Gear (Valve Driven) | | | |
| 13 | | 18 | 0.90230 | 0.87530 | Idlers (First and Second) | | | |
| 14 | | 4.96800 | Center-to-Center Distance Between Driver Gear and Driven Gear | | | | | |
| 15 | | Orientation | Driven | | | | | |
| | | | | Design Optimization Parameters . . . | | | | |
| 19 | | 3.00000 | Idler Center-to-Center Distance (in) | | | | | |
| 20 | | 3.50000 | Distance of Idler Pivot Point Above (+) [Below(−)] Driver Gear Axis | | | | | |
| 21 | | 2.20000 | Distance Between Idler Pivot Point and Idler Axis | | | | | |
| 22 | | 5.00000 | Maximum Off-symmetry angle | | | | | |
| 23 | | 85.97177 | Pivot-Point Angle Between Idler Pulley Axes (deg) | | | | | |
| 24 | | −1.46800 | Distance of Idler Pivot Point from driven gear axis (Above [+] (Below [−]) (in) | | | | | |
| | | | | Gear Axis Locations . . . | | | | |
| 28 | | x (in) | y (in) | | | x (in) | y (in) | |
| 29 | | 0.00000 | 0.00000 | Driver | | 0.00000 | 4.96800 | Driven |
| | | | | Idler Axis Locations . . . | | | | |
| 33 | | x (in) | First y (in) | OSA (deg) | | x (in) | Second y (in) | OSA (deg) |
| 34 | | −1.63456 | 2.02751 | 5.000 | | 1.35403 | 1.76604 | 5.000 |
| 35 | | −1.60861 | 1.99921 | 4.000 | | 1.38408 | 1.78994 | 4.000 |
| 36 | | −1.58217 | 1.97136 | 3.000 | | 1.41372 | 1.81435 | 3.000 |
| 37 | | −1.55525 | 1.94398 | 2.000 | | 1.44292 | 1.83928 | 2.000 |
| 38 | | −1.52786 | 1.91708 | 1.000 | | 1.47168 | 1.86472 | 1.000 |
| 39 | | −1.50000 | 1.89065 | 0.000 | | 1.50000 | 1.89065 | 0.000 |
| | | | | Center-to-Center Distance Between Gears (in) . . . | | | | |
| 43 | | 5.000 | 4.000 | 3.000 | 2.000 | 1.000 | 0.000 | OSA (deg) |
| 44 | | 2.60434 | 2.56602 | 2.52775 | 2.48955 | 2.45143 | 2.41341 | First Idler and Driver Gear |
| 45 | | 3.36426 | 3.37659 | 3.38867 | 3.40051 | 3.41211 | 3.42346 | First Idler and Driven Gear |
| 46 | | 2.22538 | 2.26265 | 2.30010 | 2.33773 | 2.37551 | 2.41341 | Second Idler and Driver Gear |
| 47 | | 3.47648 | 3.46638 | 3.45602 | 3.44542 | 3.43456 | 3.42346 | Second Idler and Driven Gear |
| | | | | Clearance Between Gears. . . | | | | |
| 51 | | 5.000 | 4.000 | 3.000 | 2.000 | 1.000 | 0.000 | OSA (deg) |
| 52 | | 0.55298 | 0.51466 | 0.47640 | 0.43820 | 0.40008 | 0.36206 | First Idler and Driver Gear |

TABLE A-1-continued

| | | | | | | | |
|---|---|---|---|---|---|---|---|
| 53 | 0.10984 | 0.12217 | 0.13426 | 0.14610 | 0.15769 | 0.16904 | First Idler and Driven Gear |
| 54 | 0.17402 | 0.21129 | 0.24875 | 0.28637 | 0.32415 | 0.36206 | Second Idler and Driver Gear |
| 55 | 0.22206 | 0.21196 | 0.20160 | 0.19100 | 0.18014 | 0.16904 | Second Idler and Driven Gear |
| 56 | | 1.24941 | | | First Idler and Second Idler | | |
| 57 | | 1.41282 | | | Driven Gear and Driver Gear | | |

Belt Disengagement Points On Driver Gear . . .

| 61 | x (in) | y (in) | OSA (deg) | | x (in) | y (in) | OSA (deg) |
|---|---|---|---|---|---|---|---|
| 62 | −1.01753 | −0.64186 | 5.000 | Left | 1.04491 | −0.59625 | 5.000 |
| 63 | −1.01925 | −0.63912 | 4.000 | | 1.04110 | −0.60289 | 4.000 |
| 64 | −1.02118 | −0.63603 | 3.000 | | 1.03753 | −0.60900 | 3.000 |
| 65 | −1.02333 | −0.63257 | 2.000 | | 1.03422 | −0.61462 | 2.000 |
| 66 | −1.02571 | −0.62872 | 1.000 | | 1.03114 | −0.61976 | 1.000 |
| 67 | −1.02831 | −0.62445 | 0.000 | | 1.02831 | −0.62445 | 0.000 |

Belt Disengagement Points On First Idler

| 71 | x (in) | Top y (in) | OSA (deg) | x (in) | Bottom y (in) | OSA (deg) |
|---|---|---|---|---|---|---|
| 72 | −2.53598 | 2.06714 | 5.000 | −2.39771 | 1.54612 | 5.000 |
| 73 | −2.51035 | 2.03075 | 4.000 | −2.37305 | 1.51986 | 4.000 |
| 74 | −2.48416 | 1.99479 | 3.000 | −2.34806 | 1.49434 | 3.000 |
| 75 | −2.45742 | 1.95926 | 2.000 | −2.32275 | 1.46956 | 2.000 |
| 76 | −2.43013 | 1.92417 | 1.000 | −2.29714 | 1.44554 | 1.000 |
| 77 | −2.40230 | 1.88953 | 0.000 | −2.27123 | 1.42231 | 0.000 |

Belt Disengagement Points On Driven Gear . . .

| 81 | x (in) | Left y (in) | OSA (deg) | x (in) | Right y (in) |
|---|---|---|---|---|---|
| 82 | −2.40380 | 5.07368 | 5.000 | 2.40343 | 4.85430 |
| 83 | −2.40465 | 5.05213 | 4.000 | 2.40438 | 4.87659 |
| 84 | −2.40531 | 5.03048 | 3.000 | 2.40513 | 4.89880 |
| 85 | −2.40578 | 5.00874 | 2.000 | 2.40566 | 4.92095 |
| 86 | −2.40605 | 4.98692 | 1.000 | 2.40599 | 4.94302 |
| 87 | −2.40612 | 4.96501 | 0.000 | 2.40612 | 4.96501 |

Belt Disengagement Points On Second Idler . . .

| 91 | x (in) | Top y (in) | OSA (deg) | x (in) | Bottom y (in) |
|---|---|---|---|---|---|
| 92 | 2.25532 | 1.72340 | 5.000 | 2.13771 | 1.31886 |
| 93 | 2.28573 | 1.75566 | 4.000 | 2.16491 | 1.33777 |
| 94 | 2.31564 | 1.78841 | 3.000 | 2.19187 | 1.35760 |
| 95 | 2.34504 | 1.82164 | 2.000 | 2.21858 | 1.37832 |
| 96 | 2.37393 | 1.85535 | 1.000 | 2.24504 | 1.39990 |
| 97 | 2.40230 | 1.88953 | 0.000 | 2.27123 | 1.42231 |

| | A | B | C | D | E | F | G |
|---|---|---|---|---|---|---|---|
| Belt Segment Lengths (in) . . . | | | | | | | |
| 101 | 5.000 | 4.000 | 3.000 | 2.000 | 1.000 | 0.000 | OSA (deg) |
| 102 | 1.21273 | 1.21596 | 1.21961 | 1.22368 | 1.22821 | 1.23320 | Note 1 |
| 103 | 2.58691 | 2.54833 | 2.50980 | 2.47132 | 2.43291 | 2.39460 | Note 2 |
| 104 | 0.54742 | 0.53690 | 0.52605 | 0.51484 | 0.50326 | 0.49130 | Note 3 |
| 105 | 3.00945 | 3.02322 | 3.03671 | 3.04992 | 3.06284 | 3.07548 | Note 4 |
| 106 | 3.67381 | 3.69538 | 3.71704 | 3.73879 | 3.76061 | 3.78252 | Note 5 |
| 107 | 3.89327 | 3.87096 | 3.84873 | 3.82658 | 3.80451 | 3.78252 | Note 6 |
| 108 | 3.13439 | 3.12318 | 3.11169 | 3.09990 | 3.08783 | 3.07548 | Note 7 |
| 109 | 0.42522 | 0.43933 | 0.45297 | 0.46617 | 0.47894 | 0.49130 | Note 8 |
| 110 | 2.20496 | 2.24257 | 2.28035 | 2.31830 | 2.35639 | 2.39460 | Note 9 |
| 111 | 1.26593 | 1.25828 | 1.25120 | 1.24468 | 1.23869 | 1.23320 | Note 10 |
| 113 | 7.870 | 7.856 | 7.845 | 7.837 | 7.832 | 7.831 | Note 11 |

TABLE A-1-continued

| | | | | | | | |
|---|---|---|---|---|---|---|---|
| 115 | 11.03032 | 11.01980 | 11.00921 | 10.99854 | 10.98784 | 10.97710 | Note 12 |
| 116 | 10.92378 | 10.93432 | 10.94494 | 10.95563 | 10.96636 | 10.97710 | Note 13 |
| 118 | 21.95409 | 21.95412 | 21.95415 | 21.95418 | 21.95419 | 21.95420 | Note. 14 |
| Phase Angle Results . . . | | | | | | | |
| 122 | 5.000 | 4.000 | 3.000 | 2.000 | 1.000 | 0.000 | OSA (deg) |
| 123 | 0.05327 | 0.04274 | 0.03213 | 0.02146 | 0.01074 | 0.00000 | |
| 124 | 1.26850 | 1.01781 | 0.76511 | 0.51090 | 0.25570 | 0.00000 | |
| 126 | 2.53700 | 2.03562 | 1.53022 | 1.02181 | 0.51140 | 0.00000 | |

Optimization Constraints . . .

| | | | |
|---|---|---|---|
| 130 | ≧ | 0.030 | Minimum Clearance Between Gears To Prevent Collisions (in) |
| 131 | ≧ | 0.001 | Minimum Belt Engagement on Idler Pulleys To Prevent Disengaged Idler Solutions (in) |
| 132 | ≧ | 6 | Minimum Belt Engagement on Driver Pulley To Prevent Belt Life-Cycle Degradation (Teeth) |
| 133 | ≦ | 0.0001 | Maximum Allowable OSA-Induced (±) Variation in Belt Pitch-Centerline Length (in) |

Note 1 - Driver Gear (Left Engaged Arc)
Note 2 - Between Driver Gear and First Idler (Disengaged)
Note 3 - First Idler (Engaged Arc)
Note 4 - Between Driven Gear and First Idler (Disengaged)
Note 5 - Driven Gear (Left Engaged Arc)
Note 6 - Driven Gear (Right Engaged Arc)
Note 7 - Between Driven Gear and Second Idler (Disengaged)
Note 8 - Second Idler (Engaged Arc)
Note 9 - Between Driven Gear and Second Idler (Disengaged)
Note 10 - Driver Gear (Right Engaged Arc)
Note 11 - Total Driver Gear Engagement (Teeth)
Note 12 - First Timing Belt Segment Pitch-Centerline Length (in)
Note 13 - Second Timing Belt Pitch-Centerline Length (in)
Note. 14 - Total Timing Belt Length (in)

TABLE A-2

Formulae for Cells in Table A-1

C4 =B4*B5
D4 =C4/25.4
C11 =(B11*B5)/PI( )/25.4/2
C12 =(B12*B5)/PI( )/25.4/2
C13 =(B13*B5)/PI( )/25.4/2
D11 =C11−B6
D12 =C12−B6
D13 =C13−B6
B15 = "Top Side" {indicates cam orientation} or "Bottom Side" {indicates crank orientation}
B23 =IF(B19/2>B21,180,2*DEGREES(ASIN((B19/2)/B21)))
B24 =B20−B14
B29 = 0
C29 = 0
F29 = 0
G29 = B14
B34 =−B21*SIN(RADIANS(D34+(B23/2)))
B35 =−B21*SIN(RADIANS(D35+(B23/2)))
B36 =−B21*SIN(RADIANS(D36+(B23/2)))
B37 =−B21*SIN(RADIANS(D37+(B23/2)))
B38 =−B21*SIN(RADIANS(D38+(B23/2)))
B39 =−B21*SIN(RADIANS(B23/2))
C34 =IF(B15="Top-Side",B20−
(B21*COS(RADIANS(D34+(B23/2)))),B20+(B21*COS(RADIANS(D34+(B23/2)))))
C35 =IF(B15="Top-Side",B20
(B21*COS(RADIANS(D35+(B23/2)))),B20+(B21*COS(RADIANS(D35+(B23/2)))))
C36 =IF(B15="Top-Side",B20−
(B21*COS(RADIANS(D36+(B23/2)))),B20+(B21*COS(RADIANS(D36+(B23/2)))))
C37 =IF(B15="Top-Side",B20−
(B21*COS(RADIANS(D37+(B23/2)))),B20+(B21*COS(RADIANS(D37+(B23/2)))))
C38 =IF(B15="Top-Side",B20−
(B21*COS(RADIANS(D38+(B23/2)))),B20+(B21*COS(RADIANS(D38+(B23/2)))))
C39 =IF(B15="Top-Side",B20−(B21*COS(RADIANS(B23/2))),B20+(B21*COS(RADIANS(B23/2))))
D34 =B22
D35 =0.8*D34
D36 =0.6*D34
D37 =0.4*D34
D38 =0.2*D34

TABLE A-2-continued

| Formulae for Cells in Table A-1 |
|---|
| D39 = 0 |
| F34 =B21*SIN(RADIANS((B23/2)−H34)) |
| F35 =B21*SIN(RADIANS((B23/2)−H35)) |
| F36 =B21*SIN(RADIANS((B23/2)−H36)) |
| F37 =B21*SIN(RADIANS((B23/2)−H37)) |
| F38 =B21*SIN(RADIANS((B23/2)−H38)) |
| F39 =B21*SIN(RADIANS((B23/2)) |
| G34 =IF(B15="Top-Side",B20−(B21*COS(RADIANS((B23/2)−H34))),B20+(B21*COS(RADIANS((B23/2)−H34)))) |
| G35 =IF(B15="Top-Side",B20−(B21*COS(RADIANS((B23/2)−H35))),B20+(B21*COS(RADIANS((B23/2)−H35)))) |
| G36 =IF(B15="Top-Side",B20−(B21*COS(RADIANS((B23/2)−H36))),B20+(B21*COS(RADIANS((B23/2)−H36)))) |
| G37 =IF(B15="Top-Side",B20−(B21*COS(RADIANS((B23/2)−H37))),B20+(B21*COS(RADIANS((B23/2)−H37)))) |
| G38 =IF(B15="Top-Side",B20−(B21*COS(RADIANS((B23/2)−H38))),B20+(B21*COS(RADIANS((B23/2)−H38)))) |
| G39 =IF(B15="Top-Side",B20−(B21*COS(RADIANS(B23/2))),B20+(B21*COS(RADIANS(B23/2)))) |
| H34 =D34 |
| H35 =D35 |
| H36 =D36 |
| H37 =D37 |
| H38 =D38 |
| H39 =D39 |
| B43 =D34 |
| B44 =SQRT((B34*B34)+(C34*C34)) |
| B45 =SQRT((B34*B34)+((G29−C34)*(G29−C34))) |
| B46 =SQRT((F34*F34)+(G34*G34)) |
| B47 =SQRT((F34*F34)+((G29−G34)*(G29−G34))) |
| C43 =D35 |
| C44 =SQRT((B35*B35)+(C35*C35)) |
| C45 =SQRT((B35*B35)+((G29−C35)*(G29−C35))) |
| C46 =SQRT((F35*F35)+(G35*G35)) |
| C47 =SQRT((F35*F35)+((G29−G35)*(G29−G35))) |
| D43 =D36 |
| D44 =SQRT((B36*B36)+(C36*C36)) |
| D45 =SQRT((B36*B36)+((G29−C36)*(G29−C36))) |
| D46 =SQRT((F36*F36)+(G36*G36)) |
| D47 =SQRT((F36*F36)+((G29−G36)*(G29−G36))) |
| E43 =D37 |
| E44 =SQRT((B37*B37)+(C37*C37)) |
| E45 =SQRT((B37*B37)+((G29−C37)*(G29−C37))) |
| E46 =SQRT((F37*F37)+(G37*G37)) |
| E47 =SQRT((F37*F37)+((G29−G37)*(G29−G37))) |
| F43 =D38 |
| F44 =SQRT((B38*B38)+(C38*C38)) |
| F45 =SQRT((B38*B38)+((G29−C38)*(G29−C38))) |
| F46 =SQRT((F38*F38)+(G38*G38)) |
| F47 =SQRT((F38*F38)+((G29−G38)*(G29−G38))) |
| G43 =SQRT((B39*B39)+(C39*C39)) |
| G44 =SQRT((B39*B39)+((G29−C39)*(G29−C39))) |
| G45 =SQRT((F39*F39)+(G39*G39)) |
| G46 =SQRT((F39*F39)+((G29−G39)*(G29−G39))) |
| G47 =SQRT((B39*B39)+(C39*C39)) |
| B51 =D34 |
| B52 =B44−D13−D11 |
| B53 =B45−D13−D12 |
| B54 =B46−D13−D11 |
| B55 =B47−D13−D12 |
| C51 =D35 |
| C52 =C44−D13−D11 |
| C53 =C45−D13−D12 |
| C54 =C46−D13−D11 |
| C55 =C47−D13−D12 |
| D51 =D36 |
| D52 =D44−D13−D11 |
| D53 =D45−D13−D12 |
| D54 =D46−D13−D11 |
| D55 =D47−D13−D12 |
| E51 =D37 |
| E52 =E44−D13−D11 |
| E53 =E45−D13−D12 |
| E54 =E46−D13−D11 |
| E55 =E47−D13−D12 |
| F51 =D38 |
| F52 =F44−D13−D11 |
| F53 =F45−D13−D12 |

TABLE A-2-continued

| Formulae for Cells in Table A-1 |
|---|
| F54 =F46−D13−D11 |
| F55 =F47−D13−D12 |
| G51 =D39 |
| G52 =G44−D13−D11 |
| G53 =G45−D13−D12 |
| G54 =G46−D13−D11 |
| G55 =G47−D13−D12 |
| B56 =B19−D13−D13 |
| B57 =B14−D11−D12 |
| B62 =B29−(COS(ASIN(ABS(B34)/B44)+ACOS((C11−C13)/B44)−(PI( )/2))*C11) |
| B63 =B29−(COS(ASIN(ABS(B35)/C44)+ACOS((C11−C13)/C44)−(PI( )/2))*C11) |
| B64 =B29−(COS(ASIN(ABS(B36)/D44)+ACOS((C11−C13)/D44)−(PI( )/2))*C11) |
| B65 =B29−(COS(ASIN(ABS(B37)/E44)+ACOS((C11−C13)/E44)−(PI( )/2))*C11) |
| B66 =B29−(COS(ASIN(ABS(B38)/F44)+ACOS((C11−C13)/F44)−(PI( )/2))*C11) |
| B67 =B29−(COS(ASIN(ABS(B39)/G44)+ACOS((C11−C13)/G44)−(PI( )/2))*C11) |
| C62 =C29−(SIN(ASIN(ABS(B34)/B44)+ACOS((C11−C13)/B44)−(PI( )/2))*C11) |
| C63 =C29−(SIN(ASIN(ABS(B35)/C44)+ACOS((C11−C13)/C44)−(PI( )/2))*C11) |
| C64 =C29−(SIN(ASIN(ABS(B36)/D44)+ACOS((C11−C13)/D44)−(PI( )/2))*C11) |
| C65 =C29−(SIN(ASIN(ABS(B37)/E44)+ACOS((C11−C13)/E44)−(PI( )/2))*C11) |
| C66 =C29−(SIN(ASIN(ABS(B38)/F44)+ACOS((C11−C13)/F44)−(PI( )/2))*C11) |
| C67 =C29−(SIN(ASIN(ABS(B39)/G44)+ACOS((C11−C13)/G44)−(PI( )/2))*C11) |
| D62 =D34 |
| D63 =D35 |
| D64 =D36 |
| D65 =D37 |
| D66 =D38 |
| D67 =D39 |
| F62 =B29+(COS(ASIN(ABS(F34)/B46)+ACOS((C11−C13)/B46)−(PI( )/2))*C11) |
| F63 =B29+(COS(ASIN(ABS(F35)/C46)+ACOS((C11−C13)/C46)−(PI( )/2))*C11) |
| F64 =B29+(COS(ASIN(ABS(F36)/D46)+ACOS((C11−C13)/D46)−(PI( )/2))*C11) |
| F65 =B29+(COS(ASIN(ABS(F37)/E46)+ACOS((C11−C13)/E46)−(PI( )/2))*C11) |
| F66 =B29+(COS(ASIN(ABS(F38)/F46)+ACOS((C11−C13)/F46)−(PI( )/2))*C11) |
| F67 =B29+(COS(ASIN(ABS(F39)/G46)+ACOS((C11−C13)/G46)−(PI( )/2))*C11) |
| G62 =C29−(SIN(ASIN(ABS(F34)/B46)+ACOS((C11−C13)/B46)−(PI( )/2))*C11) |
| G63 =C29−(SIN(ASIN(ABS(F35)/C46)+ACOS((C11−C13)/C46)−(PI( )/2))*C11) |
| G64 =C29−(SIN(ASIN(ABS(F36)/D46)+ACOS((C11−C13)/D46)−(PI( )/2))*C11) |
| G65 =C29−(SIN(ASIN(ABS(F37)/E46)+ACOS((C11−C13)/E46)−(PI( )/2))*C11) |
| G66 =C29−(SIN(ASIN(ABS(F38)/F46)+ACOS((C11−C13)/F46)−(PI( )/2))*C11) |
| G67 =C29−(SIN(ASIN(ABS(F39)/G46)+ACOS((C11−C13)/G46)−(PI( )/2))*C11) |
| H62 =D34 |
| H63 =D35 |
| H64 =D36 |
| H65 =D37 |
| H66 =D38 |
| H67 =D39 |
| B72 =B34−(COS(ASIN(ABS(B34)/B45)+ACOS((C12−C13)/B45)−(PI( )/2))*C13) |
| B73 =B35−(COS(ASIN(ABS(B35)/C45)+ACOS((C12−C13)/C45)−(PI( )/2))*C13) |
| B74 =B36−(COS(ASIN(ABS(B36)/D45)+ACOS((C12−C13)/D45)−(PI( )/2))*C13) |
| B75 =B37−(COS(ASIN(ABS(B37)/E45)+ACOS((C12−C13)/E45)−(PI( )/2))*C13) |
| B76 =B38−(COS(ASIN(ABS(B38)/F45)+ACOS((C12−C13)/F45)−(PI( )/2))*C13) |
| B77 =B39−(COS(ASIN(ABS(B39)/G45)+ACOS((C12−C13)/G45)−(PI( )/2))*C13) |
| C72 =C34+(SIN(ASIN(ABS(B34)/B45)+ACOS((C12−C13)/B45)−(PI( )/2))*C13) |
| C73 =C35+(SIN(ASIN(ABS(B35)/C45)+ACOS((C12−C13)/C45)−(PI( )/2))*C13) |
| C74 =C36+(SIN(ASIN(ABS(B36)/D45)+ACOS((C12−C13)/D45)−(PI( )/2))*C13) |
| C75 =C37+(SIN(ASIN(ABS(B37)/E45)+ACOS((C12−C13)/E45)−(PI( )/2))*C13) |
| C76 =C38+(SIN(ASIN(ABS(B38)/F45)+ACOS((C12−C13)/F45)−(PI( )/2))*C13) |
| C77 =C39+(SIN(ASIN(ABS(B39)/G45)+ACOS((C12−C13)/G45)−(PI( )/2))*C13) |
| D72 =D34 |
| D73 =D35 |
| D74 =D36 |
| D75 =D37 |
| D76 =D38 |
| D77 =D39 |
| F72 =B34−(COS(ASIN(ABS(B34)/B44)+ACOS((C11−C13)/B44)−(PI( )/2))*C13) |
| F73 =B35−(COS(ASIN(ABS(B35)/C44)+ACOS((C11−C13)/C44)−(PI( )/2))*C13) |
| F74 =B36−(COS(ASIN(ABS(B36)/D44)+ACOS((C11−C13)/D44)−(PI( )/2))*C13) |
| F75 =B37−(COS(ASIN(ABS(B37)/E44)+ACOS((C11−C13)/E44)−(PI( )/2))*C13) |
| F76 =B38−(COS(ASIN(ABS(B38)/F44)+ACOS((C11−C13)/F44)−(PI( )/2))*C13) |
| F77 =B39−(COS(ASIN(ABS(B39)/G44)+ACOS((C11−C13)/G44)−(PI( )/2))*C13) |
| G72 =C34−(SIN(ASIN(ABS(B34)/B44)+ACOS((C11−C13)/B44)−(PI( )/2))*C13) |
| G73 =C35−(SIN(ASIN(ABS(B35)/C44)+ACOS((C11−C13)/C44)−(PI( )/2))*C13) |
| G74 =C36−(SIN(ASIN(ABS(B36)/D44)+ACOS((C11−C13)/D44)−(PI( )/2))*C13) |
| G75 =C37−(SIN(ASIN(ABS(B37)/E44)+ACOS((C11−C13)/E44)−(PI( )/2))*C13) |
| G76 =C38−(SIN(ASIN(ABS(B38)/F44)+ACOS((C11−C13)/F44)−(PI( )/2))*C13) |
| G77 =C39−(SIN(ASIN(ABS(B39)/G44)+ACOS((C11−C13)/G44)−(PI( )/2))*C13) |
| H72 =D34 |
| H73 =D35 |

TABLE A-2-continued

| Formulae for Cells in Table A-1 |
|---|
| H74 =D36 |
| H75 =D37 |
| H76 =D38 |
| H77 =D39 |
| B82 =−COS(ASIN(ABS(B34)/B45)+ACOS((C12−C13)/B45)−(PI( )/2))*C12 |
| B83 =−COS(ASIN(ABS(B35)/C45)+ACOS((C12−C13)/C45)−(PI( )/2))*C12 |
| B84 =−COS(ASIN(ABS(B36)/D45)+ACOS((C12−C13)/D45)−(PI( )/2))*C12 |
| B85 =−COS(ASIN(ABS(B37)/E45)+ACOS((C12−C13)/E45)−(PI( )/2))*C12 |
| B86 =−COS(ASIN(ABS(B38)/F45)+ACOS((C12−C13)/F45)−(PI( )/2))*C12 |
| B87 =−COS(ASIN(ABS(B39)/G45)+ACOS((C12−C13)/G45)−(PI( )/2))*C12 |
| C82 =G29+(SIN(ASIN(ABS(B34)/B45)+ACOS((C12−C13)/B45)−(PI( )/2))*C12) |
| C83 =G29+(SIN(ASIN(ABS(B35)/C45)+ACOS((C12−C13)/C45)−(PI( )/2))*C12) |
| C84 =G29+(SIN(ASIN(ABS(B36)/D45)+ACOS((C12−C13)/D45)−(PI( )/2))*C12) |
| C85 =G29+(SIN(ASIN(ABS(B37)/E45)+ACOS((C12−C13)/E45)−(PI( )/2))*C12) |
| C86 =G29+(SIN(ASIN(ABS(B38)/F45)+ACOS((C12−C13)/F45)−(PI( )/2))*C12) |
| C87 =G29+(SIN(ASIN(ABS(B39)/G45)+ACOS((C12−C13)/G45)−(PI( )/2))*C12) |
| D82 =D34 |
| D83 =D35 |
| D84 =D36 |
| D85 =D37 |
| D86 =D38 |
| D87 =D39 |
| F82 =COS(ASIN(ABS(F34)/B47)+ACOS((C12−C13)/B47)−(PI( )/2))*C12 |
| F83 =COS(ASIN(ABS(F35)/C47)+ACOS((C12−C13)/C47)−(PI( )/2))*C12 |
| F84 =COS(ASIN(ABS(F36)/D47)+ACOS((C12−C13)/D47)−(PI( )/2))*C12 |
| F85 =COS(ASIN(ABS(F37)/E47)+ACOS((C12−C13)/E47)−(PI( )/2))*C12 |
| F86 =COS(ASIN(ABS(F38)/F47)+ACOS((C12−C13)/F47)−(PI( )/2))*C12 |
| F87 =COS(ASIN(ABS(F39)/G47)+ACOS((C12−C13)/G47)−(PI( )/2))*C12 |
| G82 =G29+(SIN(ASIN(ABS(F34)/B47)+ACOS((C12−C13)/B47)−(PI( )/2))*C12) |
| G83 =G29+(SIN(ASIN(ABS(F35)/C47)+ACOS((C12−C13)/C47)−(PI( )/2))*C12) |
| G84 =G29+(SIN(ASIN(ABS(F36)/D47)+ACOS((C12−C13)/D47)−(PI( )/2))*C12) |
| G85 =G29+(SIN(ASIN(ABS(F37)/E47)+ACOS((C12−C13)/E47)−(PI( )/2))*C12) |
| G86 =G29+(SIN(ASIN(ABS(F38)/F47)+ACOS((C12−C13)/F47)−(PI( )/2))*C12) |
| G87 =G29+(SIN(ASIN(ABS(F39)/G47)+ACOS((C12−C13)/G47)−(PI( )/2))*C12) |
| H82 =D34 |
| H83 =D35 |
| H84 =D36 |
| H85 =D37 |
| H86 =D38 |
| H87 =D39 |
| B92 =F34+(COS(ASIN(ABS(F34)/B47)+ACOS((C12−C13)/B47)−(PI( )/2))*C13) |
| B93 =F35+(COS(ASIN(ABS(F35)/C47)+ACOS((C12−C13)/C47)−(PI( )/2))*C13) |
| B94 =F36+(COS(ASIN(ABS(F36)/D47)+ACOS((C12−C13)/D47)−(PI( )/2))*C13) |
| B95 =F37+(COS(ASIN(ABS(F37)/E47)+ACOS((C12−C13)/E47)−(PI( )/2))*C13) |
| B96 =F38+(COS(ASIN(ABS(F38)/F47)+ACOS((C12−C13)/F47)−(PI( )/2))*C13) |
| B97 =F39+(COS(ASIN(ABS(F39)/G47)+ACOS((C12−C13)/G47)−(PI( )/2))*C13) |
| C92 =G34+(SIN(ASIN(ABS(F34)/B47)+ACOS((C12−C13)/B47)−(PI( )/2))*C13) |
| C93 =G35+(SIN(ASIN(ABS(F35)/C47)+ACOS((C12−C13)/C47)−(PI( )/2))*C13) |
| C94 =G36+(SIN(ASIN(ABS(F36)/D47)+ACOS((C12−C13)/D47)−(PI( )/2))*C13) |
| C95 =G37+(SIN(ASIN(ABS(F37)/E47)+ACOS((C12−C13)/E47)−(PI( )/2))*C13) |
| C96 =G38+(SIN(ASIN(ABS(F38)/F47)+ACOS((C12−C13)/F47)−(PI( )/2))*C13) |
| C97 =G39+(SIN(ASIN(ABS(F39)/G47)+ACOS((C12−C13)/G47)−(PI( )/2))*C13) |
| D92 =D34 |
| D93 =D35 |
| D94 =D36 |
| D95 =D37 |
| D96 =D38 |
| D97 =D39 |
| F92 =F34+(COS(ASIN(ABS(F34)/B46)+ACOS((C11−C13)/B46)−(PI( )/2))*C13) |
| F93 =F35+(COS(ASIN(ABS(F35)/C46)+ACOS((C11−C13)/C46)−(PI( )/2))*C13) |
| F94 =F36+(COS(ASIN(ABS(F36)/D46)+ACOS((C11−C13)/D46)−(PI( )/2))*C13) |
| F95 =F37+(COS(ASIN(ABS(F37)/E46)+ACOS((C11−C13)/E46)−(PI( )/2))*C13) |
| F96 =F38+(COS(ASIN(ABS(F38)/F46)+ACOS((C11−C13)/F46)−(PI( )/2))*C13) |
| F97 =F39+(COS(ASIN(ABS(F39)/G46)+ACOS((C11−C13)/G46)−(PI( )/2))*C13)G92 |
| G93 =G34−(SIN(ASIN(ABS(F34)/B46)+ACOS((C11−C13)/B46)−(PI( )/2))*C13) |
| G94 =G35−(SIN(ASIN(ABS(F35)/C46)+ACOS((C11−C13)/C46)−(PI( )/2))*C13) |
| G95 =G36−(SIN(ASIN(ABS(F36)/D46)+ACOS((C11−C13)/D46)−(PI( )/2))*C13) |
| G96 =G37−(SIN(ASIN(ABS(F37)/E46)+ACOS((C11−C13)/E46)−(PI( )/2))*C13) |
| G97 =G38−(SIN(ASIN(ABS(F38)/F46)+ACOS((C11−C13)/F46)−(PI( )/2))*C13) |
| G93 =G39−(SIN(ASIN(ABS(F39)/G46)+ACOS((C11−C13)/G46)−(PI( )/2))*C13)H92 =D34 |
| H93 =D35 |
| H94 =D36 |
| H95 =D37 |
| H96 =D38 |
| H97 =D39 |
| B101 = D34 |
| B102 = (PI( )−ASIN(ABS(B34)/B44)−ACOS((C11−C13)/B44))*C11 |

TABLE A-2-continued

| Formulae for Cells in Table A-1 |
|---|
| B103 = SQRT((B44*B44)−((C11−C13)*(C11−C13))) |
| B104 = (ASIN(ABS(B34)/B44)+ACOS((C11−C13)/B44)+ASIN(ABS(B34)/B45)+ACOS((C12−C13)/B45)−PI( ))*C13 |
| B105 = SQRT((B45*B45)−((C12−C13)*(C12−C13))) |
| B106 = (PI( )−ASIN(ABS(B34)/B45)−ACOS((C12−C13)/B45))*C12 |
| B107 = (PI( )−ASIN(ABS(F34)/B47)−ACOS((C12−C13)/B47))*C12 |
| B108 = SQRT((B47*B47)−((C12−C13)*(C12−C13))) |
| B109 = (ASIN(ABS(F34)/B47)+ACOS((C12−C13)/B47)+ASIN(ABS(F34)/B46)+ACOS((C11−C13)/B46)−PI( ))*C13 |
| B110 = SQRT((B46*B46)−((C11−C13)*(C11−C13))) |
| B111 = (PI( )−ASIN(ABS(F34)/B46)−ACOS((C11−C13)/B46))*C11 |
| B113 = ((B102+B111)/(2*PI( )*C11))*B11 |
| B115 = SUM(B102:B106) |
| B116 = SUM(B107:B111) |
| B118 = B115+B116 |
| C101 =D35 |
| C102 =(PI( )−ASIN(ABS(B35)/C44)−ACOS((C11−C13)/C44))*C11 |
| C103 =SQRT((C44*C44)−((C11−C13)*(C11−C13))) |
| C104 =(ASIN(ABS(B35)/C44)+ACOS((C11−C13)/C44)+ASIN(ABS(B35)/C45)+ACOS((C12−C13)/C45)−PI( ))*C13 |
| C105 =SQRT((C45*C45)−((C12−C13)*(C12−C13))) |
| C106 =(PI( )−ASIN(ABS(B35)/C45)−ACOS((C12−C13)/C45))*C12 |
| C107 =(PI( )−ASIN(ABS(F35)/C47)−ACOS((C12−C13)/C47))*C12 |
| C108 =SQRT((C47*C47)−((C12−C13)*(C12−C13))) |
| C109 =(ASIN(ABS(F35)/C47)+ACOS((C12−C13)/C47)+ASIN(ABS(F35)/C46)+ACOS((C11−C13)/C46)−PI( ))*C13 |
| C110 =SQRT((C46*C46)−((C11−C13)*(C11−C13))) |
| C111 =(PI( )−ASIN(ABS(F35)/C46)−ACOS((C11−C13)/C46))*C11 |
| C113 =((C102+C111)/(2*PI( )*C11))*B11 |
| C115 =SUM(C102:C106) |
| C116 =SUM(C107:C111) |
| C118 =C115+C116 |
| D101 =D36 |
| D102 =(PI( )−ASIN(ABS(B36)/D44)−ACOS((C11−C13)/D44))*C11 |
| D103 =SQRT((D44*D44)−((C11−C13)*(C11−C13))) |
| D104 =(ASIN(ABS(B36)/D44)+ACOS((C11−C13)/D44)+ASIN(ABS(B36)/D45)+ACOS((C12−C13)/D45)−PI( ))*C13 |
| D105 =SQRT((D45*D45)−((C12−C13)*(C12−C13))) |
| D106 =(PI( )−ASIN(ABS(B36)/D45)−ACOS((C12−C13)/D45))*C12 |
| D107 =(PI( )−ASIN(ABS(F36)/D47)−ACOS((C12−C13)/D47))*C12 |
| D108 =SQRT((D47*D47)−((C12−C13)*(C12−C13))) |
| D109 =(ASIN(ABS(F36)/D47)+ACOS((C12−C13)/D47)+ASIN(ABS(F36)/D46)+ACOS((C11−C13)/D46)−PI( ))*C13 |
| D110 =SQRT((D46*D46)−((C11−C13)*(C11−C13))) |
| D111 =(PI( )−ASIN(ABS(F36)/D46)−ACOS((C11−C13)/D46))*C11 |
| D113 =((D102+D111)/(2*PI( )*C11))*B11 |
| D115 =SUM(D102:D106) |
| D116 =SUM(D107:D111) |
| D118 =D115+D116 |
| E101 =D37 |
| E102 =(PI( )−ASIN(ABS(B37)/E44)−ACOS((C11−C13)/E44))*C11 |
| E103 =SQRT((E44*E44)−((C11−C13)*(C11−C13))) |
| E104 =(ASIN(ABS(B37)/E44)+ACOS((C11−C13)/E44)+ASIN(ABS(B37)/E45)+ACOS((C12−C13)/E45)−PI( ))*C13 |
| E105 =SQRT((E45*E45)−((C12−C13)*(C12−C13))) |
| E106 =(PI( )−ASIN(ABS(B37)/E45)−ACOS((C12−C13)/E45))*C12 |
| E107 =(PI( )−ASIN(ABS(F37)/E47)−ACOS((C12−C13)/E47))*C12 |
| E108 =SQRT((E47*E47)−((C12−C13)*(C12−C13))) |
| E109 =(ASIN(ABS(F37)/E47)+ACOS((C12−C13)/E47)+ASIN(ABS(F37)/E46)+ACOS((C11−C13)/E46)−PI( ))*C13 |
| E110 =SQRT((E46*E46)−((C11−C13)*(C11−C13))) |
| E111 =(PI( )−ASIN(ABS(F37)/E46)−ACOS((C11−C13)/E46))*C11 |
| E113 =((E102+E111)/(2*PI( )*C11))*B11 |
| E115 =SUM(E102:E106) |
| E116 =SUM(E107:E111) |
| E118 =E115+E116 |
| F101 =D38 |
| F102 =(PI( )−ASIN(ABS(B38)/F44)−ACOS((C11−C13)/F44))*C11 |
| F103 =SQRT((F44*F44)−((C11−C13)*(C11−C13))) |
| F104 =(ASIN(ABS(B38)/F44)+ACOS((C11−C13)/F44)+ASIN(ABS(B38)/F45)+ACOS((C12−C13)/F45)−PI( ))*C13 |
| F105 =SQRT((F45*F45)−((C12−C13)*(C12−C13))) |
| F106 =(PI( )−ASIN(ABS(B38)/F45)−ACOS((C12−C13)/F45))*C12 |
| F107 =(PI( )−ASIN(ABS(F38)/F47)−ACOS((C12−C13)/F47))*C12 |
| F108 =SQRT((F47*F47)−((C12−C13)*(C12−C13))) |
| F109 =(ASIN(ABS(F38)/F47)+ACOS((C12−C13)/F47)+ASIN(ABS(F38)/F46)+ACOS((C11−C13)/F46)−PI( ))*C13 |

TABLE A-2-continued

| Formulae for Cells in Table A-1 |
|---|
| F110 =SQRT((F46*F46)−((C11−C13)*(C11−C13))) |
| F111 =(PI( )−ASIN(ABS(F38)/F46)−ACOS((C11−C13)/F46))*C11 |
| F113 =((F102+F111)/(2*PI( )*C11))*B11 |
| F115 =SUM(F102:F106) |
| F116 =SUM(F107:F111) |
| F118 =F115+F116 |
| G101 =D39 |
| G102 =(PI( )−ASIN(ABS(B39)/G44)−ACOS((C11−C13)/G44))*C11 |
| G103 =SQRT((G44*G44)−((C11−C13)*(C11−C13))) |
| G104 =(ASIN(ABS(B39)/G44)+ACOS((C11−C13)/G44)+ASIN(ABS(B39)/G45)+ACOS((C12−C13)/G45)−PI( ))*C13 |
| G105 =SQRT((G45*G45)−((C12−C13)*(C12−C13))) |
| G106 =(PI( )−ASIN(ABS(B39)/G45)−ACOS((C12−C13)/G45))*C12 |
| G107 =(PI( )−ASIN(ABS(F39)/G47)−ACOS((C12−C13)/G47))*C12 |
| G108 =SQRT((G47*G47)−((C12−C13)*(C12−C13))) |
| G109 =(ASIN(ABS(F39)/G47)+ACOS((C12−C13)/G47)+ASIN(ABS(F39)/G46)+ACOS((C11−C13)/G46)−PI( ))*C13 |
| G110 =SQRT((G46*G46)−((C11−C13)*(C11−C13))) |
| G111 =(PI( )−ASIN(ABS(F39)/G46)−ACOS((C11−C13)/G46))*C11 |
| G113 =((G102+G111)/(2*PI( )*C11))*B11 |
| G115 =SUM(G102:G106) |
| G116 =SUM(G107:G111) |
| G118 =G115+G116H101 |
| B122 = D34 |
| B123 = ABS(B115−B116)/2 |
| B124 = DEGREES(B123/$C$12) |
| B126 = 2*B124 |
| C122 = D35 |
| C123 = ABS(C115−C116)/2 |
| C124 = DEGREES(C123/$C$12) |
| C126 = 2*C124 |
| D122 = D36 |
| D123 = ABS(D115−D116)/2 |
| D124 = DEGREES(D123/$C$12) |
| D126 =2*D124 |
| E122 = D37 |
| E123 = ABS(E115−E116)/2 |
| E124 = DEGREES(E123/$C$12) |
| E126 = 2*E124 |
| F122 = D38 |
| F123 = ABS(F115−F116)/2 |
| F124 = DEGREES(F123/$C$12) |
| F126 = 2*F124 |
| G122 = D39 |
| G123 = ABS(G115−G116)/2 |
| G124 = DEGREES(G123/$C$12) |
| G126 = 2*G124 |

TABLE A-3

| | |
|---|---|
| Optimize | B19:B22 |
| Subject to constraints | B104:G104 ≥ B131<br>B109:G109 ≥ B131<br>B113:G113 ≥ B132<br>B118:G118 ≤ D4 + B133<br>B118:G118 ≥ D4 - B133<br>B19 ≤ 2 * B21<br>B21 ≥ D13 + 1/2 * B130<br>B22 ≤ 45 |

What is claimed is:

1. A phase shift apparatus, comprising:

a movable base continuously positionable between at least a base first position and a base second position;

a first idler, the first idler defines a first idler axis of rotation, the first idler disposed about the movable base and adapted to engage a first timing belt segment of a timing belt;

a second idler, the second idler defines a second idler axis of rotation, the second idler disposed about the movable base a fixed idler center-to-center distance from the first idler, the second idler adapted to engage a second timing belt segment of the timing belt; and a path fixed in space and traversed by the first idler axis of rotation and the second idler axis of rotation as the movable base is positioned between at least the base first position and the base second position, the path configured such that a first segment length of the first timing belt segment changes in correspondence to changes in a second segment length of the second timing belt segment to maintain a constant timing belt length.

2. The phase shift apparatus, as in claim 1, further comprising: the movable base slidably engagable with a slot disposed about an internal combustion engine to slide between the base first position and the base second position.

3. The phase shift apparatus, as in claim 1, further comprising: a movable base shaft, the movable base shaft adapted to secure the movable base about the engine block of an internal combustion engine, the movable base shaft adapted to allow the movable base to rotate about the movable base shaft as the movable base is positioned between at least the base first position and the base second position.

4. The phase shift apparatus, as in claim 1, further comprising:

a driver gear;

a driven gear; and a timing belt, the timing belt engaged with the driver gear, the driven gear, the first idler, and the second idler.

5. The phase shift apparatus, as in claim 4, further comprising: an internal combustion engine with the driver gear in mechanical cooperation with a crankshaft thereof and the driven gear in mechanical cooperation with a camshaft thereof.

6. A phase shift apparatus, comprising:

a first idler adapted to engage a first timing belt segment of a timing belt;

a second idler positioned a fixed distance from the first idler and adapted to engage a second timing belt segment of the timing belt; and, a path fixedly defined in space such that changes in a first segment length of the first timing belt segment correspond to changes in a second timing belt segment length of the second timing belt segment in a continuous manner to maintain a substantially constant timing belt length of the timing belt when the first idler and the second idler are traversed upon the path between a first position and a second position.

7. The phase shift apparatus, as in claim 6, wherein the path is configured as an arc disposed at a pivot radius about an idler pivot point.

8. The phase shift apparatus, as in claim 7, further comprising:

a line defined by a driver axis of a driver gear and a driven axis of a driven gear, the pivot radius disposed upon the line exclusive of the driver axis and exclusive of the driven axis.

9. A phase shift apparatus, comprising:

a first idler adapted to engage a first timing belt segment of a timing belt;

a second idler adapted to engage a second timing belt segment of the timing belt and disposed a fixed idler center-to-center distance from the first idler; and a path configured as an arc fixed in space and disposed at a pivot radius about an idler pivot point, the path defined such that changes in a first segment length of the first timing belt segment correspond to changes in a second segment length of the second timing belt segment in a continuous manner to maintain a substantially constant timing belt length of the timing belt as the first idler and the second idler traverse the path between at least a first position and a second position.

10. A method of phase shifting, comprising the step of:

defining a fixed path in space such that changes in a first segment length of a first timing belt segment of a timing belt correspond continuously to changes in a second timing belt segment length of a second timing belt segment of the timing belt thereby maintaining a constant timing belt length of the timing belt when traversing a first idler engaged with the first timing belt segment and a second idler engaged with a second timing belt segment upon the path, the first idler a fixed distance from the second idler.

11. The method, as in claim 10, wherein the path is defined using an optimization method.

12. The method, as in claim 10, wherein the step of defining a path comprises the steps of:

determining an idler center-to-center distance;

determining a location of the idler pivot point;

determining a pivot radius; and determining a maximum off-symmetry angle.

13. The method, as in claim 12, wherein the idler center-to-center distance, the location of the idler pivot point, the pivot radius, and the maximum off-symmetry angle are determined using an optimization method.

14. The method, as in claim 10, further comprising the step of:

altering the phase relationship between a driver gear engaged with the timing belt and a driven gear engaged with the timing belt by traversing the first idler and the second idler along the path between at least a first position and a second position.

15. The method, as in claim 14, further comprising the step of:

positioning a movable base between at least a base first position and a base second position thereby traversing the first idler and the second idler along the path, the first idler and the second idler disposed about the moveable base.

16. The method, as in claim 14, wherein the driver gear, the driven gear, the timing belt, the first idler, and the second idler are disposed about an internal combustion engine.

17. The phase shift apparatus, as in claim 14, wherein the driver gear is in communication with a crankshaft of an internal combustion engine and the driven gear is in communication with a camshaft of the internal combustion engine.

18. The method, as in claim 10, wherein the path is configured as an arc disposed at a pivot radius about an idler pivot point.

19. The method, as in claim 18, wherein a driver axis of a driver gear and a driven axis of a driven gear define a line, the pivot radius is disposed upon the line exclusive of the driver axis and exclusive of the driven axis.

20. A phase shift apparatus, comprising:

a path fixed in space and defined such that a first segment length of a first timing belt segment of a timing belt changes continuously in substantial correspondence to changes in a second segment length of a second timing belt segment of the timing belt to maintain a substantially constant timing belt length of the timing belt as the path is traversed by a first idler and a second idler set a fixed distance from one another while engaged with the timing belt.

* * * * *